US007223000B2

(12) United States Patent
Yamamura

(10) Patent No.: US 7,223,000 B2
(45) Date of Patent: May 29, 2007

(54) VEHICLE LIGHTING DEVICE

(75) Inventor: Satoshi Yamamura, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/444,299

(22) Filed: Jun. 1, 2006

(65) Prior Publication Data

US 2006/0274546 A1 Dec. 7, 2006

(30) Foreign Application Priority Data

Jun. 1, 2005 (JP) ..... P.2005-160984

(51) Int. Cl.
*F21W 101/10* (2006.01)

(52) U.S. Cl. ..... 362/518; 362/517; 362/297; 362/346

(58) Field of Classification Search ..... 362/516, 362/517, 518, 519, 520, 521, 522, 297, 346
See application file for complete search history.

(56) References Cited

U.S. PATENT DOCUMENTS 4,839,781 A 6/1989 Barnes et al.
5,975,723 A * 11/1999 Daumueller et al. ..... 362/297
6,007,223 A * 12/1999 Futami ..... 362/517

FOREIGN PATENT DOCUMENTS

JP 5-120903 A 5/1993

* cited by examiner

*Primary Examiner*—Laura K. Tso
(74) *Attorney, Agent, or Firm*—Sughrue Mion, PLLC

(57) ABSTRACT

Light emitted from the light source, which is disposed above an optical axis extending in front and rear direction of a vehicle lighting device, is reflected toward front of the vehicle lighting device by a reflector made of a transmissive member. An exterior surface of the reflector is formed with a plurality of protruding portions extending in a radial pattern with respect to the optical axis. Each of the protruding portions has a total reflection prism having a cross sectional shape perpendicular to the optical axis, which is approximately a V shape. The reflector is divided into twelve fan-shaped reflective regions, each having three protruding portions. The fan-shaped reflective regions, which are located in the left and right directions of the optical axis, reflect the light emitted from the light source in the direction more deviating from a direction along the optical axis than the fan-shaped reflective regions, which are located at the upper and lower directions of the optical axis.

6 Claims, 23 Drawing Sheets

VEHICLE LIGHTING DEVICE

The present application claims foreign priority based on Japanese Patent Application No. P.2005-160984, filed on Jun. 1, 2005, the contents of which are incorporated herein by reference.

BACKGROUND OF THE INVENTION

1. Field of the Invention

The present invention relates to a vehicle lighting device with a reflector having a transmissive member.

2. Related Art

In vehicle lighting devices, light emitted from a light source on an optical axis extending in front and rear direction is reflected toward a front side by a reflector. Disclosed in JP-A-05-120903 is a reflector having a transmissive member.

In a vehicle lighting device disclosed in JP-A-05-120903, an exterior surface of the reflector of the transmissive member is formed with a plurality of total reflection prisms so that light emitted from a light source is reflected toward a front side of the lighting device by using the total reflection in each of the total reflection prisms.

In addition, discloses in U.S. Pat. No. 4,839,781 is a reflector made of a transmissive member having an exterior surface formed with a plurality of protruding portions extending in a radial pattern with respect to an optical axis and each of the protruding portions has a total reflection prism of which a cross section belonging to a plane perpendicular to the optical axis is set to have approximately a V shape, even though the device disclosed in U.S. Pat. No. 4,839,781 is not a vehicle lighting device.

As disclosed in JP-A-05-120903 and U.S. Pat. No. 4,839,781, in the case in which the reflector is made of the transmissive member and the exterior surface of the reflector is formed with a plurality of total reflection prisms, it is possible to omit a process of forming a mirror surface on the reflector, which allows a cost of manufacturing a lighting device to be saved.

In this case, by constructing such that a vehicle lighting device includes the reflector as disclosed in U.S. Pat. No. 4,839,781, it is possible to realize the total reflection on the exterior surface over almost an entire region of the reflector and to make the direction of the totally reflected light approximately parallel to the direction of light reflected from an interior surface. Accordingly, most of the light beams emitted from a light source can be effectively used as illumination light emitted toward the front side of the lighting device.

However, since the exterior surface of the reflector disclosed in U.S. Pat. No. 4,839,781 is formed with the plurality of protruding portions extending in a radial pattern with respect to an optical axis, the light distribution pattern formed by the light reflected from the reflector becomes a circular light distribution pattern, which causes a problem in that it is not possible to form a horizontally long light distribution pattern that the vehicle lighting device is supposed to form.

In this case, for some of the plurality of protruding portions, by properly changing the angle of inclination of a pair of inclined surfaces forming the protruding portion, it is possible to make the light reflected from a corresponding protruding portion slightly diffused in the direction of a tangential line of the circumference with respect to the optical axis. However, at this time, when the angle of inclination changes largely, the total reflection at the protruding portion cannot be maintained. For this reason, from the view point of an effective use of light beams emitted from a light source, the allowable variation amount of the angle of inclination of each inclined surface is extremely small. Accordingly, even though it is possible to slightly change the shape of the circular light distribution pattern by using the construction described above, the problem in which the horizontally long light distribution pattern cannot be formed still occurs.

SUMMARY OF THE INVENTION

One or more embodiments of the invention provide a vehicle lighting device with a reflector made of a transmissive member, which is capable of forming a horizontally long light distribution pattern such that most of the light beams emitted from a light source can be effectively used as illumination light emitted toward a front side of the vehicle lighting device.

In accordance with one or more embodiments of the present invention, an exterior surface of a reflector made of a transmissive member is formed with a plurality of protruding portions extending in a radial pattern with respect to an optical axis, and the exterior surface of the reflector is divided into a plurality of fan-shaped reflective regions and the configuration of each of the protruding portions is set to be different according to the position of the fan-shaped reflective region.

Moreover, in accordance with one or more embodiments of the present invention, a vehicle lighting device is provided with: a light source disposed on an optical axis extending in front and rear directions of the vehicle lighting device; and a reflector having a transmissive member that reflects light emitted from the light source toward a front of the vehicle lighting device. The reflector includes a plurality of fan-shaped reflective regions. Each of the plurality of fan-shaped reflective regions includes a predetermined number of protruding portions formed on an exterior surface of the reflector and extending in a radial direction with respect to the optical axis. Each of the protruding portions has a total reflection prism of which a cross section belonging to a plane perpendicular to the optical axis is set to have approximately a V shape. A fan-shaped reflective region of the plurality of fan-shaped reflective regions located in left and right directions of the optical axis reflects the light emitted from the light source in a direction deviating from the direction of the optical axis within a plane including the optical axis, more than a fan-shaped reflective region located in up and down directions of the optical axis.

The 'vehicle lighting device' is not specially limited, but for example, a headlamp, a fog lamp, a cornering lamp, a tail lamp, a stop lamp, a back up lamp, a turn signal lamp, a daytime running lamp may be adopted as the vehicle lighting device.

The 'front and rear directions' may be equal to the front and rear directions of a vehicle or different from the front and rear directions of the vehicle.

The 'light source' is not specially limited, but for example, a light-emitting portion of a discharge bulb or a halogen bulb, or a light-emitting chip of a light-emitting element, such as a light-emitting diode, may be adopted as the light source.

The periphery of the 'reflector' may not necessarily completely surround the optical axis. In addition, a material of the 'transmissive member' forming the reflector is not specially limited as long as it has a transmissive property.

For example, a synthetic resin or a glass may be used as the material of the transmissive member.

The 'protruding portion' means a protruding portion extending in a line shape.

A specific value of 'predetermined number' of protruding portions included in each of the fan-shaped reflective regions is not specially limited. For example, the predetermined number may be one or two or more. In addition, the fan-shaped reflective regions have the same number of fan-shaped reflective regions or a different number of fan-shaped reflective regions.

As long as the 'plurality of fan-shaped reflective regions' is configured such that the fan-shaped reflective regions located in the left and right directions of, the optical axis reflect the light emitted from the light source in the direction deviating from the direction of the optical axis within the plane including the optical axis more than the fan-shaped reflective regions located in the up and down directions of the optical axis, the specific configurations of fan-shaped reflective regions other than the fan-shaped reflective regions located in the left and right directions of the optical axis and the fan-shaped reflective regions located in the up and down directions of the optical axis are not specially limited.

The 'direction deviating from the direction of the optical axis within the plane including the optical axis' may be equal to the direction of the corresponding fan-shaped reflective region with respect to the optical axis or opposite thereto.

A specific configuration for realizing that the 'fan-shaped reflective regions located in the left and right directions of the optical axis' reflect the light emitted from the light source in the direction deviating from the direction of the optical axis within the plane including the optical axis more than the 'fan-shaped reflective regions located in the up and down directions of the optical axis' is not specially limited.

The condition in which the light emitted from the light source is 'reflected in the direction deviating from the direction of the optical axis' may be either a condition in which all of the light beams emitted from the light source is reflected in the direction deviating from the direction of the optical axis or a condition in which some of the light beams emitted from the light source is reflected in the direction deviating from the direction of the optical axis.

The 'fan-shaped reflective region located in the left and right directions of the optical axis' means a fan-shaped reflective region located in the vicinity of a horizontal plane including the optical axis. At this time, if a fan-shaped reflective region crossing the horizontal plane including the optical axis exists, the fan-shaped reflective region is the 'fan-shaped reflective region located in the left and right directions of the optical axis', and if the fan-shaped reflective region crossing the horizontal plane including the optical axis does not exist, a fan-shaped reflective region closest to the horizontal plane including the optical axis is the 'fan-shaped reflective region located in the left and right directions of the optical axis'.

The 'fan-shaped reflective region located in the up and down directions of the optical axis' means a fan-shaped reflective region located in the vicinity of a vertical plane including the optical axis. At this time, if a fan-shaped reflective region crossing the vertical plane including the optical axis exists, the fan-shaped reflective region is the 'fan-shaped reflective region located in the up and down directions of the optical axis', and if the fan-shaped reflective region crossing the vertical plane including the optical axis does not exist, a fan-shaped reflective region closest to the vertical plane including the optical axis is the 'fan-shaped reflective region located in the up and down directions of the optical axis'.

If a pair of fan-shaped reflective regions corresponding to the 'fan-shaped reflective regions located in the left and right directions of the optical axis' exist at the left and right sides of the optical axis, preferably, at least one of the fan-shaped reflective regions reflects the light emitted from the light source in the direction deviating from the direction of the optical axis more than the fan-shaped reflective regions (more than any of a pair of fan-shaped reflective regions, if the pair of fan-shaped reflective regions corresponding to the 'fan-shaped reflective regions located in the up and down directions of the optical axis' exists at the up and down sides of the optical axis) located in the up and down directions of the optical axis.

As can be seen from the configuration described above, in accordance with one or more embodiments of the present invention, in the vehicle lighting device, the light emitted from the light source, which is disposed on the optical axis extending in the front and rear directions of the vehicle lighting device, is reflected toward the front of the vehicle lighting device by means of the reflector having the transmissive member. In addition, the exterior surface of the reflector is formed with the plurality of protruding portions extending in a radial pattern with respect to the optical axis, and each of the protruding portions has a total reflection prism of which a cross section belonging to the plane perpendicular to the optical axis is set to have approximately a V shape. Accordingly, it is possible to realize the total reflection on the exterior surface over almost an entire region of the reflector and to make the direction of the totally reflected light approximately parallel to the direction of light reflected from the interior surface of the reflector. As a result, most of the light beams emitted from the light source can be effectively used as illumination light emitted toward the front side of the lighting device.

The reflector is divided into a plurality of fan-shaped reflective regions each having a predetermined number of protruding portions, and among the plurality of fan-shaped reflective regions, the fan-shaped reflective regions located in the left and right directions of the optical axis reflect the light emitted from the light source in the direction deviating from the direction of the optical axis within the plane including the optical axis more than the fan-shaped reflective regions located in the up and down directions of the optical axis. Accordingly, it is possible to form a horizontally long light distribution pattern by means of the light reflected from the reflector.

As describe above, in the vehicle lighting device with the reflector having the transmissive member according to one or more embodiments of the present invention, the horizontally long light distribution pattern can be formed such that most of the light beams emitted from the light source can be effectively used as the illumination light emitted toward the front side of the vehicle lighting device.

In the invention, it has been described that the specific configuration, in which the fan-shaped reflective regions located in the left and right directions of the optical axis reflect the light emitted from the light source in the direction deviating from the direction of the optical axis more than the fan-shaped reflective regions located in the up and down directions of the optical axis, is not specially limited. Further, in accordance with one or more embodiments of the present invention, the cross sectional shape of the interior surface of each of the fan-shaped reflective regions located in the up and down directions of the optical axis may be a parabola having the optical axis as a symmetrical axis and a point near the light source as a focus and the cross sectional shape of an interior surface of each of the fan-shaped reflective regions located in the left and right directions of the optical axis may be the curve obtained by modifying the parabola. When the vehicle lighting device has the above configuration, the following effects can be obtained. That is, as compared with a light distribution pattern formed in a case in which the cross sectional shape is the parabola, the light distribution pattern formed by the light reflected from the fan-shaped reflective regions located in the left and right directions of the optical axis can be formed as a horizontally long light distribution pattern obtained, for example, by extending the light distribution pattern formed in the above case in the left and right directions. As a result, the light distribution pattern, which is formed by the entire light illumination from the vehicle lighting device, can also be formed as a horizontally long light distribution pattern. At this time, it is possible to adopt, for example, a hyperbola or an ellipse as the curve obtained by modifying the parabola.

Alternatively, the cross sectional shape of an interior surface of each of the fan-shaped reflective regions located in the up and down directions of the optical axis may be a parabola having the optical axis as a symmetrical axis and a point near the light source as a focus and the cross sectional shape of an interior surface of each of the fan-shaped reflective regions located in the left and right directions of the optical axis may be a curve obtained by making the parabola inclined within the plane with the focus as the center. When the vehicle lighting device has the above configuration, the following effects can be obtained. That is, as compared with the light distribution pattern formed in the case in which the cross sectional shape is the parabola, the light distribution pattern formed by the light reflected from the fan-shaped reflective regions located in the left and right directions of the optical axis can be formed as a light distribution pattern obtained by moving the light distribution pattern in parallel in the left and right directions thereof. As a result, the light distribution pattern, which is formed by the entire light illumination from the vehicle lighting device, can be formed as a horizontally long light distribution pattern.

Alternatively, the cross sectional shape of an interior surface of each of the fan-shaped reflective regions located in the up and down directions of the optical axis may be a parabola having the optical axis as a symmetrical axis and a point near the light source as a focus and the axis-including cross sectional shape of an interior surface of each of the fan-shaped reflective regions located in the left and right directions of the optical axis may be a curve obtained by moving the parabola in parallel within the plane. When the vehicle lighting device has the above configuration, the following effects can be obtained. That is, as compared with the light distribution pattern formed in the case in which the cross sectional shape is the parabola, the light distribution pattern formed by the light reflected from the fan-shaped reflective regions located in the left and right directions of the optical axis can be formed as a light distribution pattern obtained by moving the light distribution pattern in parallel in the left and right directions thereof. As a result, the light distribution pattern, which is formed by the entire light illumination from the vehicle lighting device, can be formed as a horizontally long light distribution pattern. At this time, the direction in which the parabola moves in parallel within the plane including the optical axis may be the front and rear directions, the left and right directions, or the inclined direction.

Alternatively, the cross sectional shape of an interior surface of each of the fan-shaped reflective regions located in the up and down directions of the optical axis may be a parabola having the optical axis as a symmetrical axis and a point near the light source as a focus and the axis-including cross sectional shape of an interior surface of each of the fan-shaped reflective regions located in the left and right directions of the optical axis may be a waveform curve having irregularities with the parabola as a reference line, the following effects can be obtained. That is, as compared with the light distribution pattern formed in the case in which the cross sectional shape is the parabola, the light distribution pattern formed by the light reflected from the fan-shaped reflective regions located in the left and right directions of the optical axis can be formed as a horizontally long light distribution pattern obtained, for example, by extending the light distribution pattern formed in the above case in the left and right directions. As a result, the light distribution pattern, which is formed by the entire light illumination from the vehicle lighting device, can also be formed as a horizontally long light distribution pattern.

In addition, as the specific configuration in which the fan-shaped reflective regions located in the left and right directions of the optical axis reflect the light emitted from the light source in the direction deviating from the direction of the optical axis more than the fan-shaped reflective regions located in the up and down directions of the optical axis, those configurations described above may be properly combined.

In addition, by configuring such that the shape of a cross section, which belongs to the plane perpendicular to the optical axis, of the interior surface of each of the fan-shaped reflective regions is set to be an arc shape having the optical axis as the center and the shapes of cross sections, which belong to the plane perpendicular to the optical axis, of a pair of inclined surfaces forming each of the protruding portions are set to be convex curves, it is possible to make the light, which is emitted from the light source to be then incident on each of the fan-shaped reflective regions, reflected toward the same direction as the light incident on the corresponding fan-shaped reflective region in high precision as viewed from the front side of the lighting device, as compared with a case in which those shape are straight lines.

Other aspects and advantages of the invention will be apparent from the following description and the appended claims.

DETAILED DESCRIPTION OF THE EXEMPLARY EMBODIMENTS

Exemplary embodiments of the invention will be described with reference to the accompanying drawings.

First, a first exemplary embodiment of the invention will be described.

Figure 1:
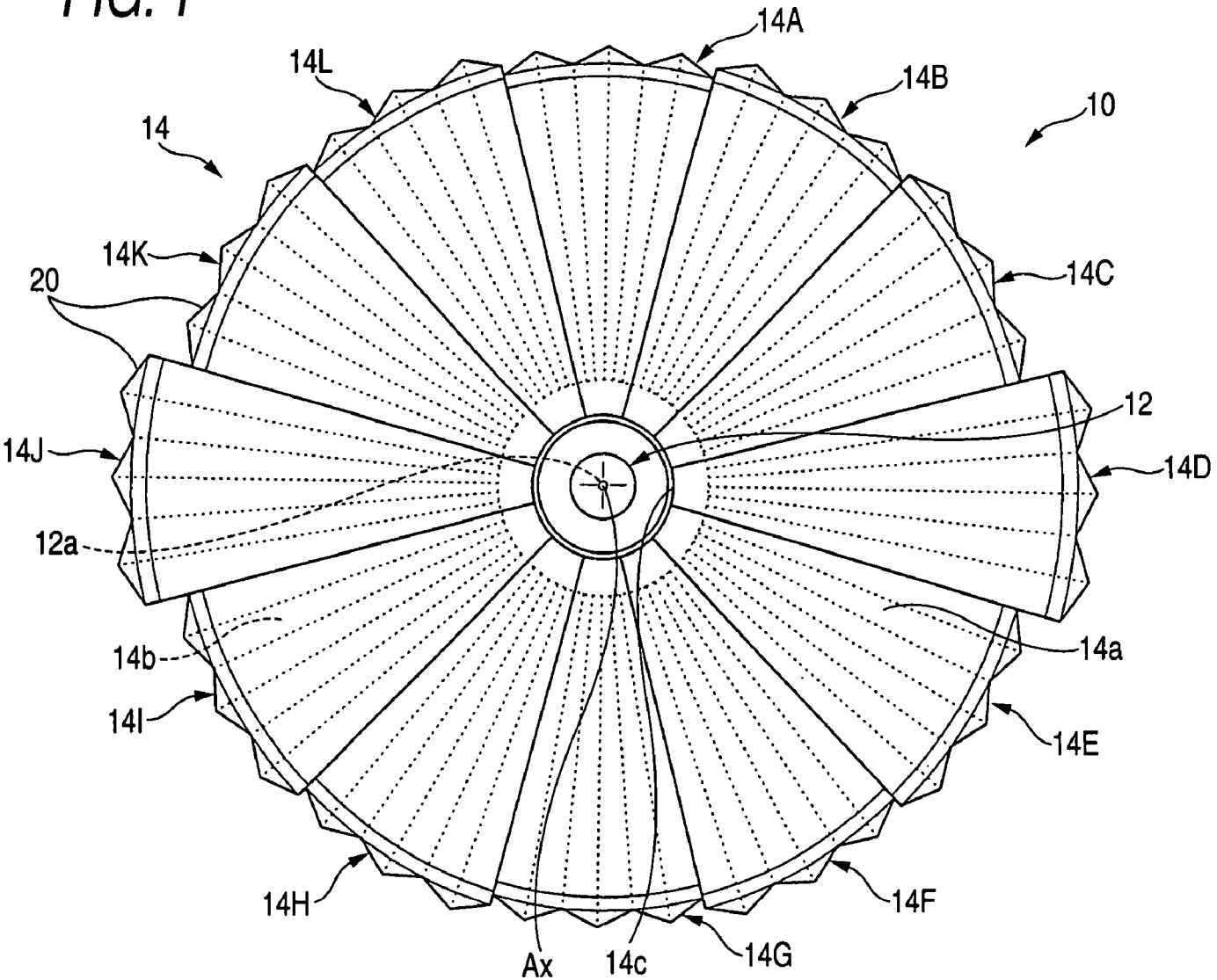
FIG. 1 is a front view illustrating a vehicle lighting device according to a first exemplary embodiment of the invention.
Figure 2:
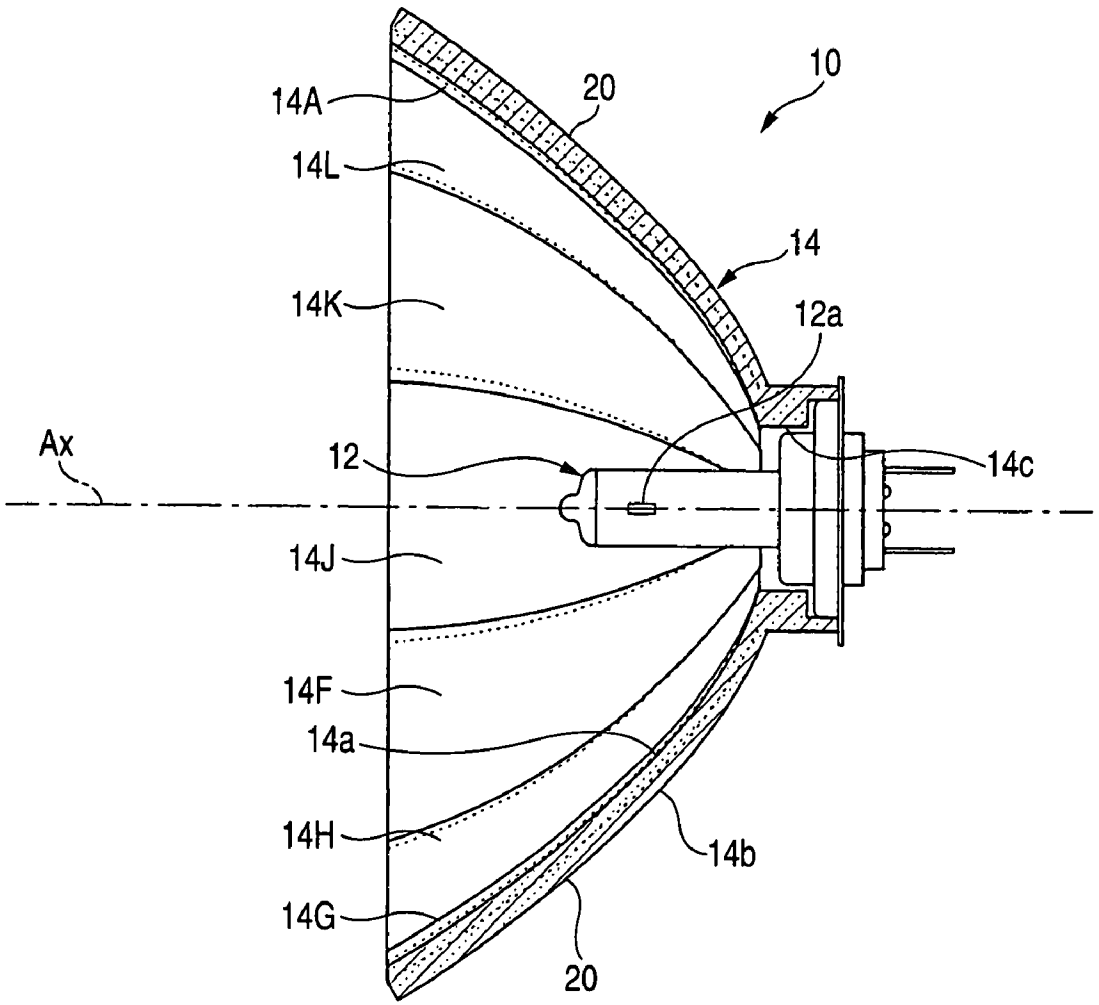
FIG. 2 is a side sectional view of the vehicle lighting device shown in FIG. 1.
Figure 3:
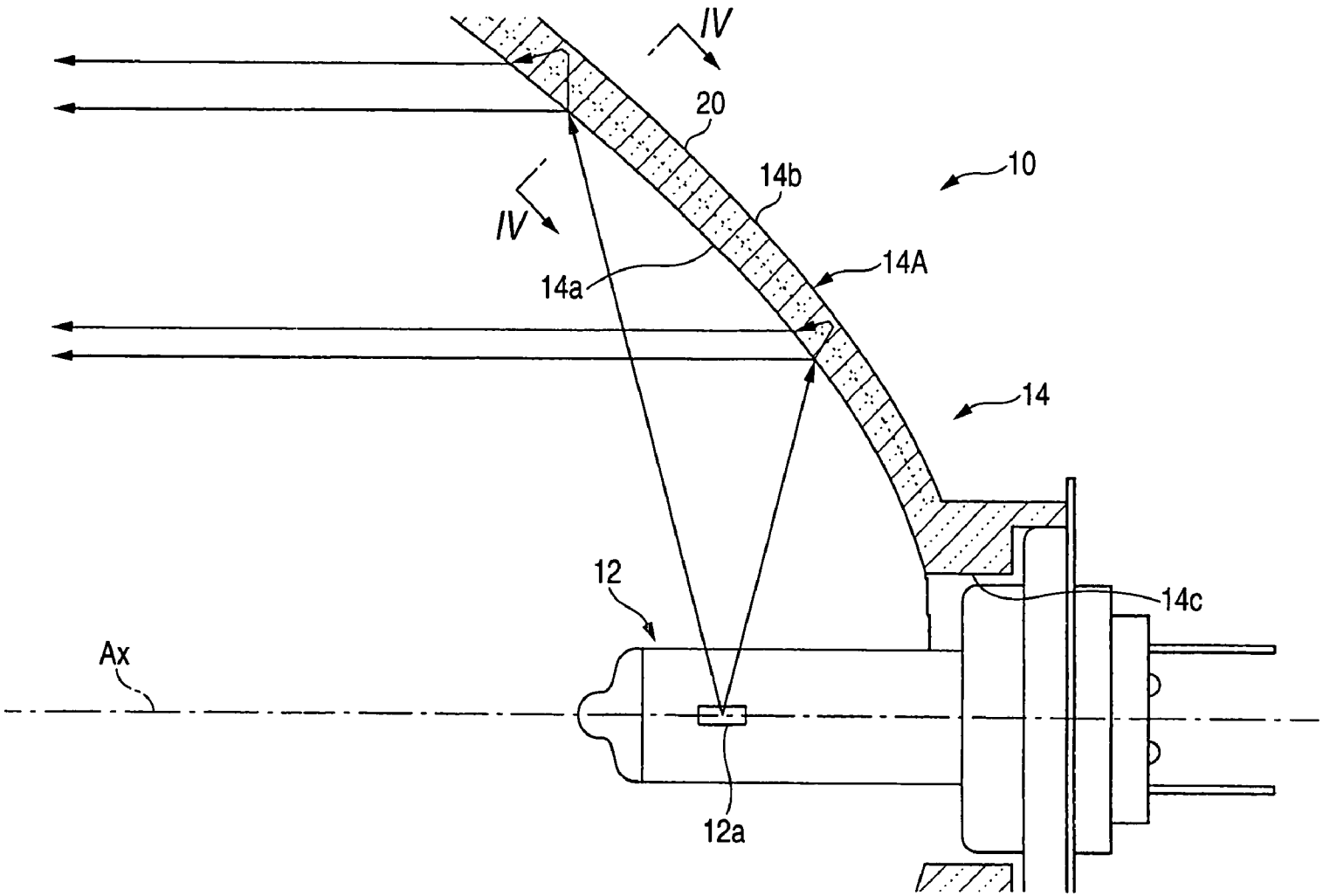
FIG. 3 is a detailed view illustrating main parts shown in FIG. 2.

FIG. 1 is a front view illustrating a vehicle lighting device according to the present exemplary embodiment, FIG. 2 is a side sectional view of the vehicle lighting device shown in FIG. 1, and FIG. 3 is a detailed view illustrating main parts shown in FIG. 2.

As shown in FIGS. 1 to 3, a vehicle lighting device 10 according to the present exemplary embodiment is composed of a headlamp unit that illuminates light so as to form a high-beam mode light distribution pattern and is used in a state being located within a lamp body (not shown), for example.

The vehicle lighting device 10 includes a light source bulb 12, which is disposed on an optical axis Ax extending in the front and rear directions of the vehicle lighting device 10, and a reflector 14 which reflects light emitted from the light source bulb 12 toward a front side of the vehicle lighting device 10, and the vehicle lighting device 10 is used in a state in which the optical axis Ax extends in the front and rear directions of a vehicle.

The light source bulb 12 is a halogen bulb that uses a filament as a light source 12*a*, and the light source 12*a* is a linear light source extending along a central axis of a bulb. In addition, the light source bulb 12 is inserted into an opening portion 14*c* located at a rear vertex of the reflector 14 so as to be fixed, and the light source 12*a* is disposed along the optical axis Ax.

The reflector 14 includes a transmissive member made of transparent resin. For example, transparent and colorless acrylic resin or polycarbonate resin may be used as the transparent resin forming the transmissive member.

The reflector 14 is divided into twelve fan-shaped reflective regions 14A, 14B, 14C, 14D, 14E, 14F, 14G, 14H, 14I, 14J, 14K, and 14L each having central angle of 30° with respect to the optical axis Ax as the center.

An interior surface 14*a* of each of the fan-shaped reflective regions 14A, 14B, 14C, 14D, 14E, 14F, 14G, 14H, 14I, 14J, 14K, and 14L is a single curve. On the other hand, an exterior surface 14*b* of each of the fan-shaped reflective regions 14A, 14B, 14C, 14D, 14E, 14F, 14G, 14H, 14I, 14J, 14K, and 14L is composed of three protruding portions 20 extending in a radial pattern with respect to the optical axis Ax.

Each of the protruding portions 20 is formed with a total reflection prism protruding portions 20 of which a cross sectional shape (hereinafter, simply referred to as a 'cross sectional shape perpendicular to the optical axis Ax') belonging to a plane perpendicular to the optical axis Ax is set to have approximately a V shape. At this time, in each of the fan-shaped reflective regions 14A, 14B, 14C, 14D, 14E, 14F, 14G, 14H, 14I, 14J, 14K, and 14L, the three protruding portions 20 forming the exterior surface 14*b* have the same shapes.

Figure 4:
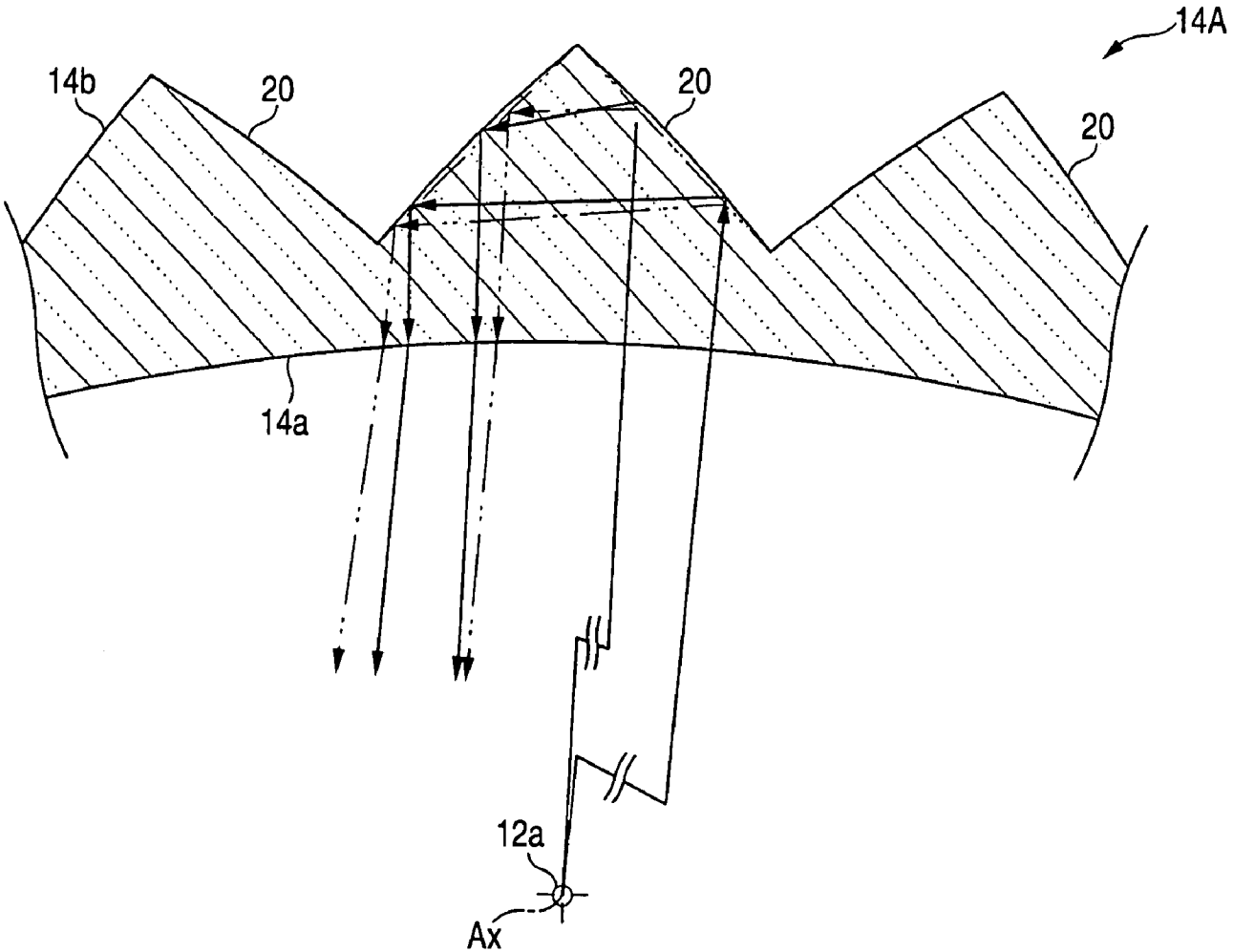
FIG. 4 is a detailed cross-sectional view taken along the line IV—IV of FIG. 3.

FIG. 4 is a detailed cross-sectional view taken along the line IV—IV of FIG. 3. In addition, FIG. 5 is a perspective view illustrating a part of the fan-shaped reflective region 14A, which is located immediately above the optical axis Ax, and the light source 12*a*.

Figure 5:
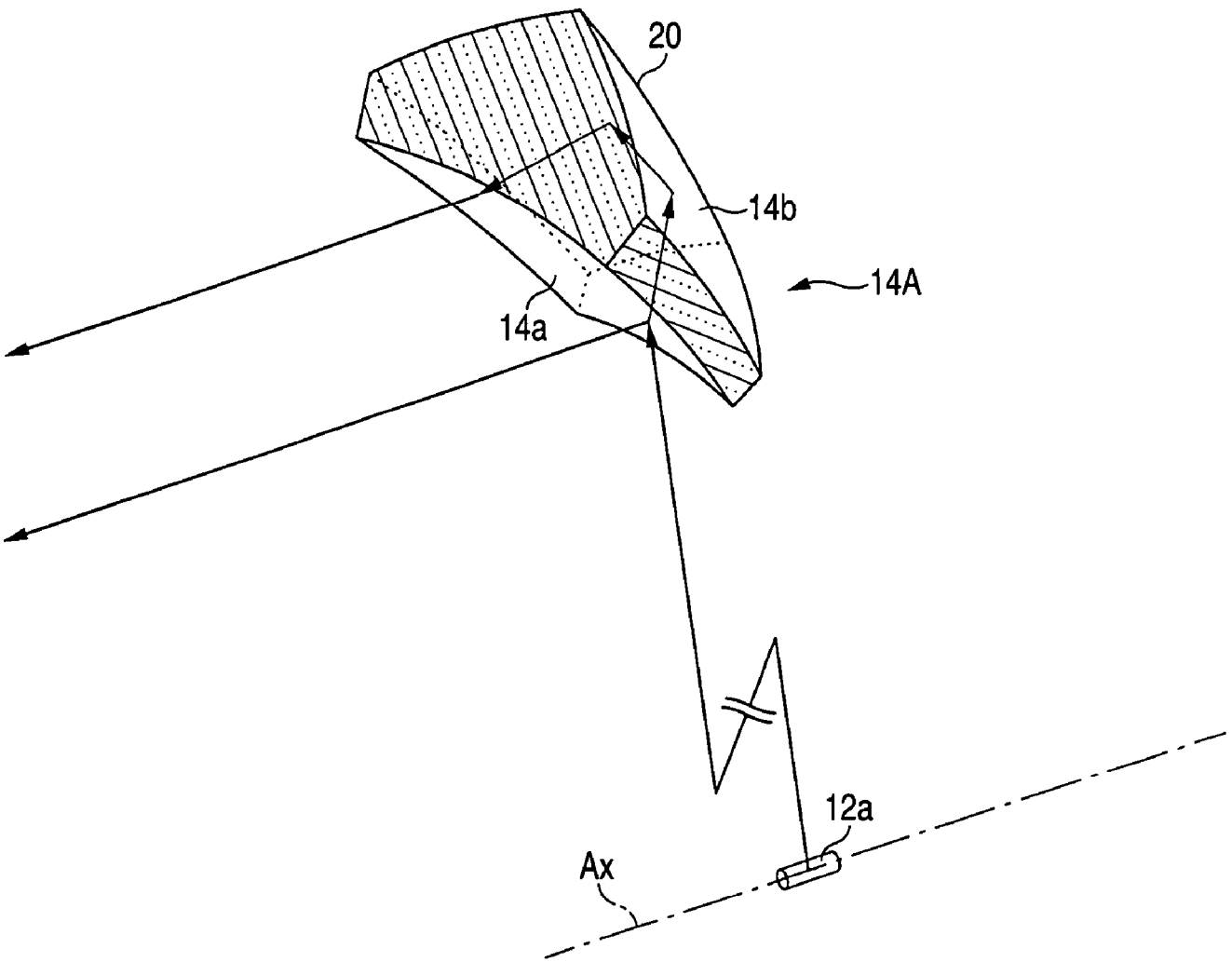
FIG. 5 is a perspective view illustrating a part of a fan-shaped reflective region, which is located immediately above an optical axis, and a light source.

As shown in FIGS. 4 and 5, the interior surface 14*a* of the fan-shaped reflective region 14A is composed of a rotary parabolic surface of which the center is the optical axis Ax and a focus is an emission center of the light source 12*a*. Accordingly, some of the light beams reaching from the light source 12*a* to the fan-shaped reflective region 14A are reflected from the interior surface 14*a* of the fan-shaped reflective region 14A in a direction parallel to the optical axis Ax.

On the other hand, in each of the protruding portions 20 forming the exterior surface 14*b* of the fan-shaped reflective region 14A, the pair of inclined surfaces is all convex curved surfaces. At this time, in the pair of inclined surfaces forming each protruding portion 20, the cross sectional shape perpendicular to the optical axis Ax is set to be approximately a circular arc and convex curve shape, and the vertical angle of the prism is set to approximately 90° within a cross section vertical to the interior surface 14*a*. Thus, light, which reaches from the light source 12*a* to the interior surface 14*a* of the fan-shaped reflective region 14A and then penetrates into each protruding portion 20, is totally reflected and is then emitted in the same direction as an incidence direction toward the fan-shaped reflective region 14A as viewed from the front side of the lighting device.

Hereinafter, an operation of the total reflection on the exterior surface 14*b* of the fan-shaped reflective region 14A will be described in detail.

That is, as shown in FIG. 4, in the interior surface 14*a* of the fan-shaped reflective region 14A, the cross sectional shape perpendicular to the optical axis Ax is an arc shape having the optical axis Ax as the center; therefore, within a plane perpendicular to the optical axis Ax, the light emitted from the light source 12*a* is incident on the interior surface 14*a* at a right angle, totally reflected by the pair of inclined surfaces forming each protruding portion 20 twice, and then outgoes from the interior surface 14*a*.

At this time, as shown by double-dotted chain line in FIG. 4, assuming that each protruding portion 20 is composed of a right-angle prism, light emitted from the light source 12*a* to be then incident on the fan-shaped reflective region 14A is totally reflected by the pair of inclined surfaces forming each protruding portion 20 twice and then returns in the same direction as before the total reflections. At a time when the light reaches the interior surface 14*a*, since the location at which the light reaches the interior surface 14*a* is apart from the incidence location, the light is not positioned at a right angle with respect to the interior surface 14*a*. Accordingly, the light is refracted when the light outgoes from the interior surface 14*a*, and as a result, the direction of the light outgoing from the fan-shaped reflective region 14A becomes different from the direction of the light incident on the fan-shaped reflective region 14A.

For this reason, in the present exemplary embodiment, since the cross sectional shape perpendicular to the optical axis Ax in the pair of inclined surfaces forming each protruding portion 20 is set to a convex curved shape, light emitted from the light source 12*a* to be then incident on the fan-shaped reflective region 14A is totally reflected by the pair of inclined surfaces forming each protruding portion 20 twice and then returns not in the same direction from before the total reflections but in the direction slightly inclined toward the incidence location. Even at a time when the light reaches the interior surface 14*a*, since the light is not positioned at a right angle with respect to the interior surface 14*a*, the light is refracted when the light outgoes from the interior surface 14*a*. Due to the refraction, the outgoing direction of the light can be the same as the incidence direction.

As shown in FIGS. 3 and 5, each protruding portion 20 forming the fan-shaped reflective region 14A is formed such that the thickness thereof increases gradually from an inner periphery of the fan-shaped reflective region 14A toward an outer periphery thereof and the curvatures of the pair of inclined surfaces gradually vary. Thus, the light outgoing from the fan-shaped reflective region 14A becomes light parallel to the optical axis Ax, in the same manner as light reflected from the interior surface 14*a*.

Hereinafter, a more detailed description will be made.

In order to explain the operation of the total reflection on the exterior surface 14*b* of the fan-shaped reflective region 14A, it has been described in FIG. 4 that the light is incident and outgoes within a plane perpendicular to the optical axis Ax. However, in reality, as shown in FIGS. 3 and 5, the light emitted from the light source 12*a* is not incident at a right angle with respect to each position of the fan-shaped reflective region 14A, and the light emitted from the light source 12*a* outgoes from the fan-shaped reflective region 14A at a location farther than the incidence location of light toward the fan-shaped reflective region 14A. Therefore, by gradually increasing the thickness of each protruding portion 20 from the inner periphery of the fan-shaped reflective region 14A toward the outer periphery thereof and gradually varying the curvatures of the pair of inclined surfaces, the light outgoing from the fan-shaped reflective region 14A can be parallel to the optical axis Ax.

Among the eleven fan-shaped reflective regions 14B, 14C, 14D, 14E, 14F, 14G, 14H, 14I, 14J, 14K, and 14L, which form the reflector 14, other than the fan-shaped reflective region 14A, the fan-shaped reflective region 14G located immediately below the optical axis Ax has completely the same configuration as the fan-shaped reflective region 14A. The other ten fan-shaped reflective regions 14B, 14C, 14D, 14E, 14F, 14H, 14I, 14J, 14K, and 14L has approximately the same configuration as the fan-shaped reflective region 14A; however, the shape of a cross section, which belongs to a plane including the optical axis Ax, of the interior surface 14*a* of each of the ten fan-shaped reflective regions 14B, 14C, 14D, 14E, 14F, 14H, 14I, 14J, 14K, and 14L is different from that of the fan-shaped reflective region 14A.

Figure 6:
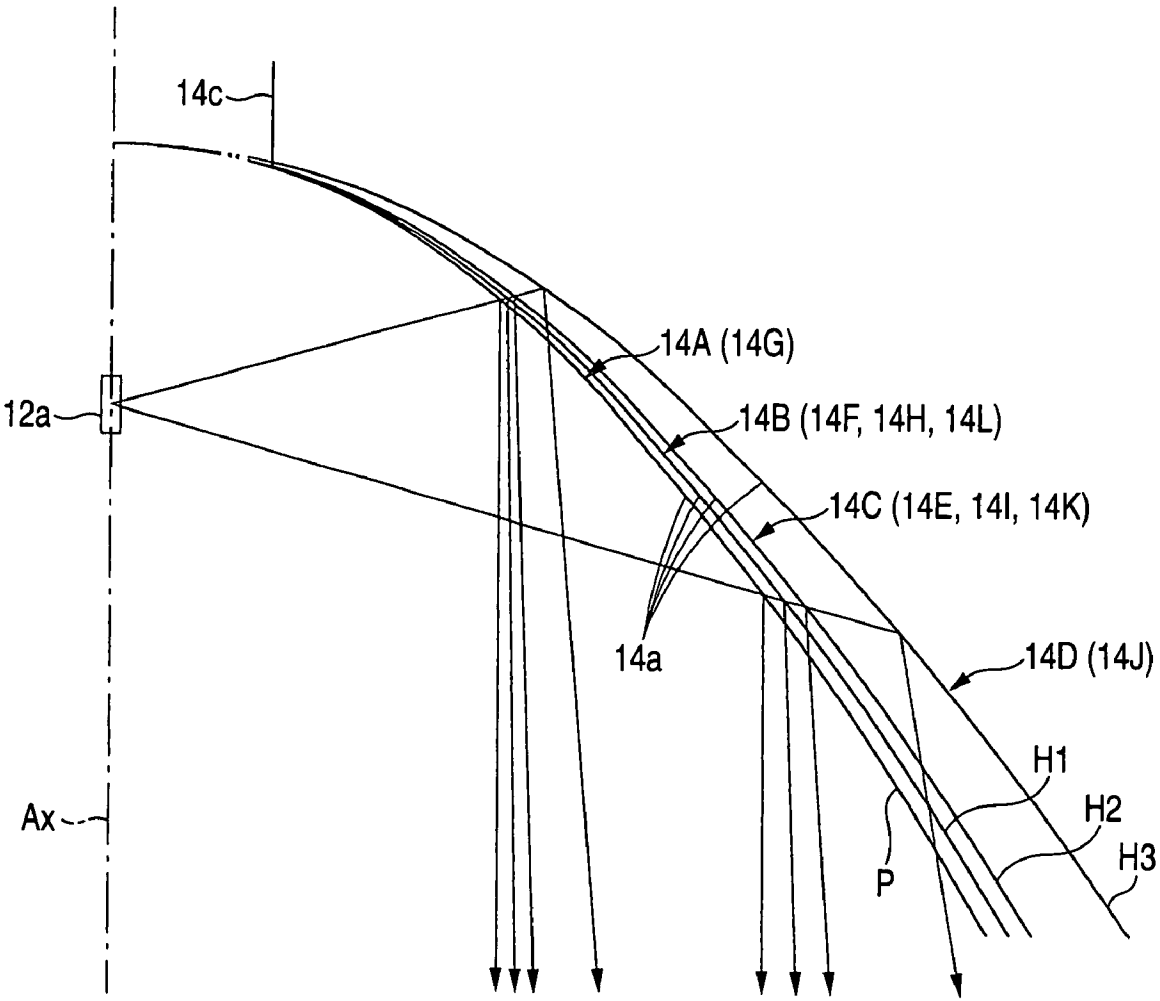
FIG. 6 is a view illustrating the shape of a cross section, which belongs to a plane including the optical axis, of an interior surface of each of the fan-shaped reflective regions included in a reflector of the vehicle lighting device.

FIG. 6 is a view illustrating the shape of a cross section, which belongs to a plane including the optical axis Ax, of the interior surface 14*a* of each of the fan-shaped reflective regions 14A, 14B, 14C, 14D, 14E, 14F, 14G, 14H, 14I, 14J, 14K, and 14L included in the reflector 14.

In FIG. 6, the shape (hereinafter, simply referred to as an 'axis-including cross sectional shape') of across section, which belongs to a plane including the optical axis Ax, of the interior surface 14*a* of the fan-shaped reflective region 14A located immediately above the optical axis Ax is composed of a parabola P (that is, the shape of a cross section including the central axis in the rotary parabolic surface) having the optical axis Ax as a symmetrical axis and the emission center of the light source 12*a* as a focus. This is the same as for the fan-shaped reflective region 14G located immediately below the optical axis Ax.

The axis-including cross sectional shape of the interior surface 14*a* of each of the fan-shaped reflective regions 14B and 14L, which are adjacent to left and right sides of the fan-shaped reflective region 14A, and the fan-shaped reflective regions 14F and 14H, which are adjacent to left and right sides of the fan-shaped reflective region 14G, is a hyperbola H1 obtained by slightly expanding the parabola P in the direction deviating from the optical axis Ax. The focus of the hyperbola H1 is positioned at the emission center of the light source 12*a*. Accordingly, by means of the fan-shaped reflective regions 14B, 14L, 14F, and 14H, it is possible to reflect the light emitted from the light source 12*a* so as to be slightly diffused in the direction deviating from the optical axis Ax.

The axis-including cross sectional shape of the interior surface 14*a* of each of the fan-shaped reflective regions 14C and 14K, which are adjacent to a right side of the fan-shaped reflective region 14B and a left side of the fan-shaped reflective region 14L, and the axis-including cross sectional shape of the interior surface 14*a* of each of the fan-shaped reflective regions 14E and 14I, which are adjacent to a right side of the fan-shaped reflective region 14F and a left side of the fan-shaped reflective region 14H, is a hyperbola H2 obtained by expanding the parabola P in the direction deviating from the optical axis Ax more than for the hyperbola H1. The focus of the hyperbola H2 is positioned at the emission center of the light source 12*a*. Accordingly, by means of the fan-shaped reflective regions 14C, 14K, 14E, and 14I, it is possible to reflect the light emitted from the light source 12*a* so as to be diffused in the direction deviating from the optical axis Ax and at an angle slightly larger than in the fan-shaped reflective regions 14B, 14L, 14F, and 14H.

The axis-including cross sectional shape of the interior surface 14*a* of each of the pair of fan-shaped reflective regions 14D and 14J, which are disposed in the left and right directions of the optical axis Ax, is a hyperbola H3 obtained by expanding the parabola P in the direction deviating from the optical axis Ax more than for the hyperbola H2. The focus of the hyperbola H3 is positioned at the emission center of the light source 12*a*. Accordingly, by means of the fan-shaped reflective regions 14D and 14J, it is possible to reflect the light emitted from the light source 12*a* so as to be diffused in the direction deviating from the optical axis Ax and at an angle larger than in the fan-shaped reflective regions 14C, 14K, 14E, and 14I.

Figure 7:
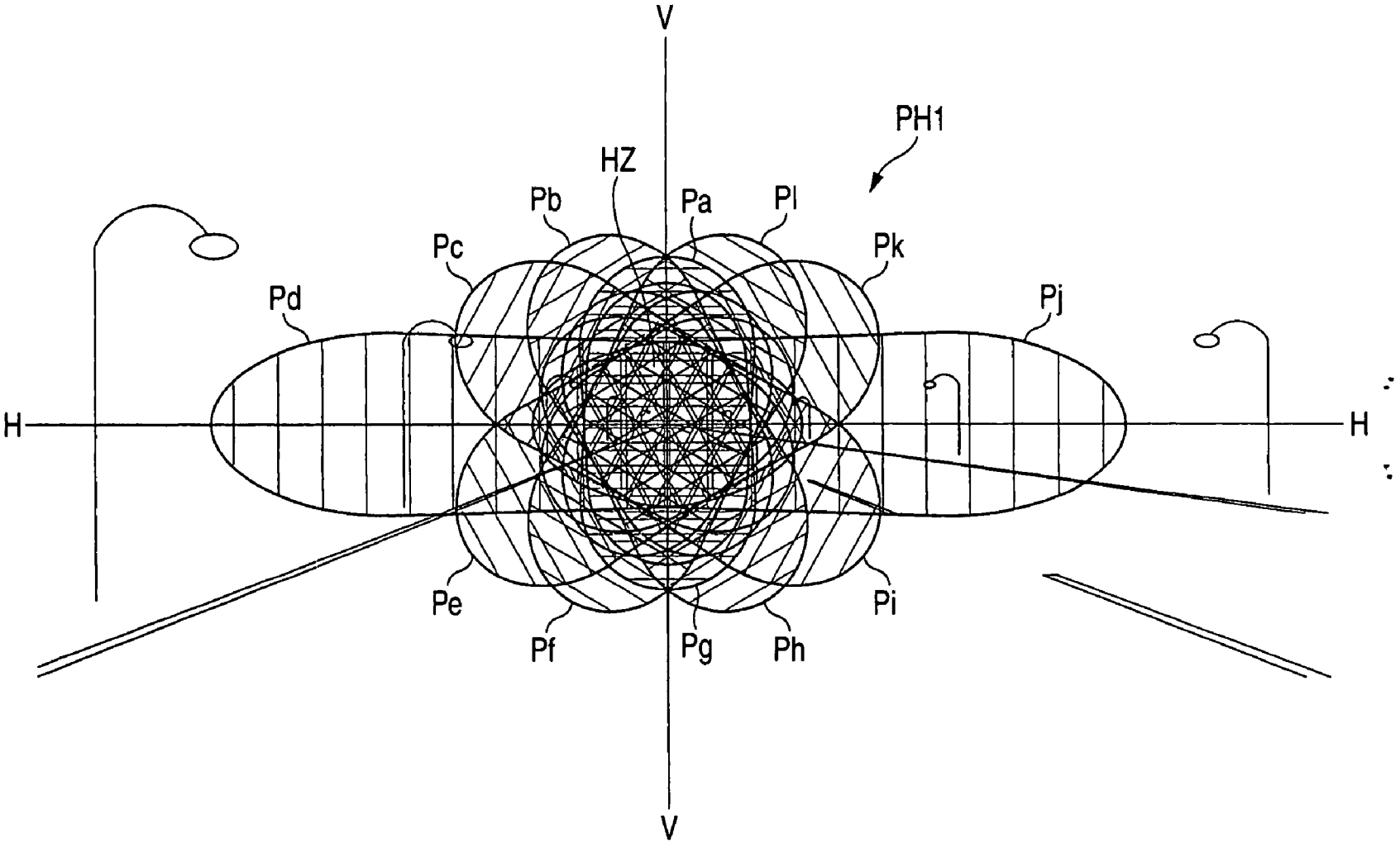
FIG. 7 is a perspective view illustrating a high-beam mode light distribution pattern formed on a virtual vertical screen, which is disposed at the location that is 25 m from the vehicle lighting device, by means of light illuminated toward the front from the vehicle lighting device.

FIG. 7 is a perspective view illustrating a high-beam mode light distribution pattern formed on a virtual vertical screen, which is disposed at the location that is 25 m from the vehicle lighting device 10, by means of light illuminated toward the front from the vehicle lighting device 10 according to the present exemplary embodiment.

The high-beam mode light distribution pattern PH1 is a horizontally long light distribution pattern expanding in left and right directions with respect to H-V as a vanishing point and has a hot zone HZ, which is a high light intensity region, in the central portion thereof.

The high-beam mode light distribution pattern PH1 is a synthesized light distribution pattern obtained by overlapping twelve light distribution patterns Pa, Pb, Pc, Pd, Pe, Pf, Pg, Ph, Pi, Pj, Pk, and Pl that are formed by the light reflected from the twelve fan-shaped reflective regions 14A, 14B, 14C, 14D, 14E, 14F, 14G, 14H, 14I, 14J, 14K, and 14L included in the reflector 14.

Figure 8:
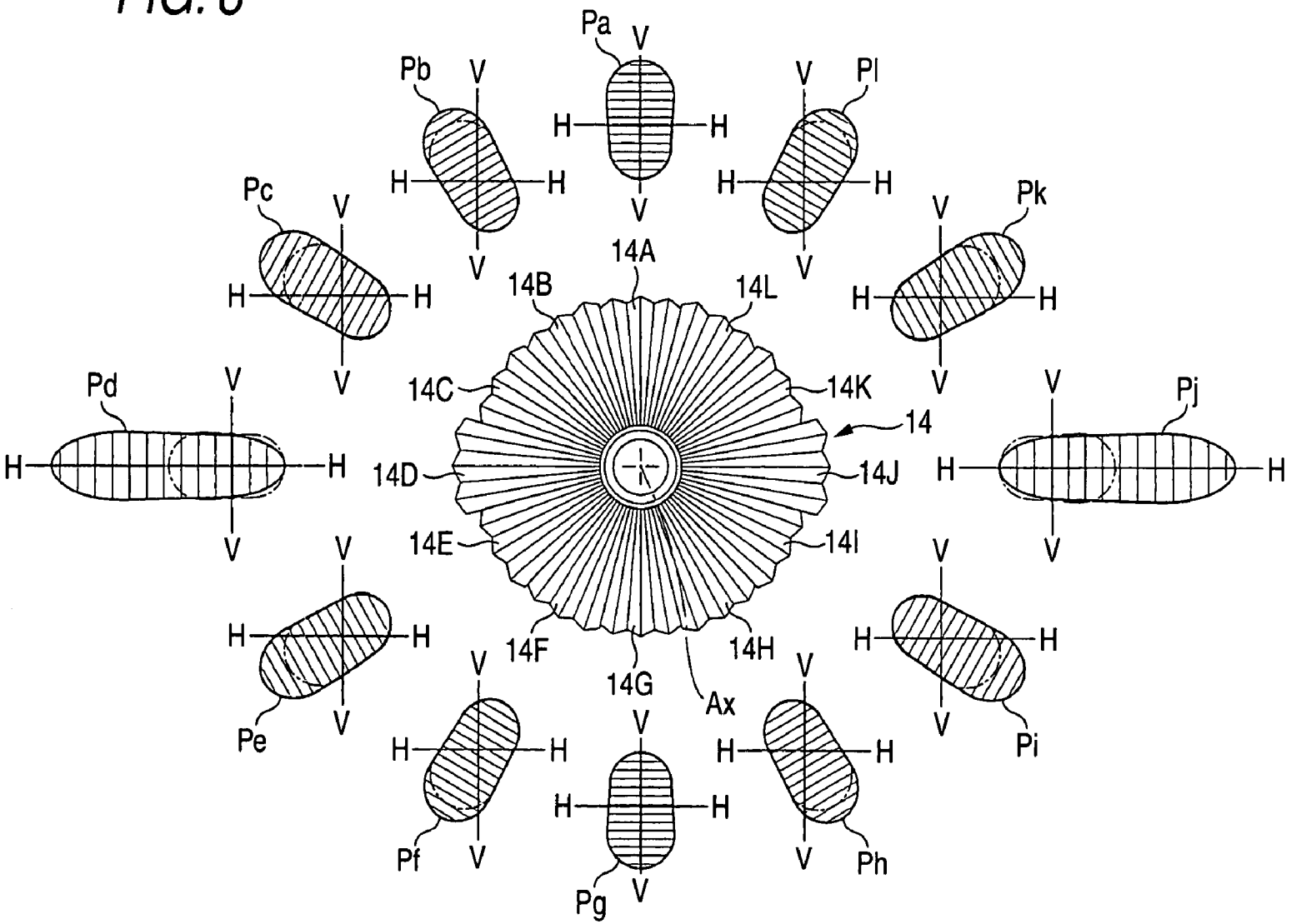
FIG. 8 is a view illustrating the corresponding relationships between each of the fan-shaped reflective regions included in the reflector and each of the light distribution patterns forming a high-beam mode light distribution pattern, as viewed from the rear side of the reflector in the vehicle lighting device.

FIG. 8 is a view illustrating the corresponding relationships between each of the fan-shaped reflective regions 14A, 14B, 14C, 14D, 14E, 14F, 14G, 14H, 14I, 14J, 14K, and 14L included in the reflector 14 and each of the light distribution patterns Pa, Pb, Pc, Pd, Pe, Pf, Pg, Ph, Pi, Pj, Pk, and Pl forming the high-beam mode light distribution pattern PH1, as viewed from the rear side of the reflector 14.

As shown in FIG. 8, each of the light distribution patterns Pa, Pb, Pc, Pd, Pe, Pf, Pg, Ph, Pi, Pj, Pk, and Pl is formed with respect to H-V, in the same manner as the positional relationship of an angle of each of the fan-shaped reflective regions 14A, 14B, 14C, 14D, 14E, 14F, 14G, 14H, 14I, 14J, 14K, and 14L with respect to the optical axis Ax.

Since the axis-including cross sectional shape of the interior surface 14*a* of the fan-shaped reflective regions 14A and 14G is the parabola P, the light distribution patterns Pa and Pg become spot shaped light distribution patterns each having H-V as the center. At this time, each of the light distribution patterns Pa and Pg has approximately an elliptical shape which is slightly long in the vertical direction, because the light source 12*a* is a linear light source disposed along the optical axis Ax.

Further, since the axis-including cross sectional shape of the interior surface 14*a* of each of the fan-shaped reflective regions 14B, 14F, 14H, and 14L is the hyperbola H1 obtained by slightly expanding the parabola P in the direction deviating from the optical axis Ax, each of the light distribution patterns Pb, Pf, Ph, and Pl becomes a light distribution pattern obtained by slightly expanding the light distribution pattern, which is shown by a double dotted chain line and is formed in a case when the axis-including cross sectional shape of the interior surface 14*a* is the parabola P, in the direction deviating from H-V along the longitudinal direction thereof.

Furthermore, since the axis-including cross sectional shape of the interior surface 14*a* of each of the fan-shaped reflective regions 14C, 14E, 14I, and 14K is the hyperbola H2 obtained by expanding the parabola P in the direction deviating from the optical axis Ax more than for the hyperbola H1, each of the light distribution patterns Pc, Pe, Pi, and Pk becomes a light distribution pattern obtained by expanding the light distribution pattern, which is shown by a double dotted chain line and is formed in a case when the axis-including cross sectional shape of the interior surface 14*a* is the parabola P, in the direction deviating from H-V along the longitudinal direction thereof and at an angle slightly larger than for the light distribution patterns Pb, Pf, Ph, and Pl.

Furthermore, since the axis-including cross sectional shape of the interior surface 14*a* of the fan-shaped reflective regions 14D and 14J is the hyperbola H3 obtained by expanding the parabola P in the direction deviating from the optical axis Ax more than for the hyperbola H2, each of the light distribution patterns Pd and Pj becomes a light distribution pattern obtained by expanding the light distribution pattern, which is shown by a double dotted chain line and is formed in a case when the axis-including cross sectional shape of the interior surface 14*a* is the parabola P, in the direction deviating from H-V along the longitudinal direction thereof and at an angle larger than for the light distribution patterns Pc, Pe, Pi, and Pk. At this time, each of the light distribution patterns Pd and Pj becomes a horizontally long light distribution pattern expanding in the left and right directions along the line H—H.

As described above in detail, the vehicle lighting device 10 according to the present exemplary embodiment reflects the light emitted from the light source 12*a*, which is disposed on the optical axis Ax extending in the front and rear direction of the vehicle lighting device 10, toward the front of the vehicle lighting device 10 by using the reflector 14 with a transmissive member. Here, since the exterior surface 14*b* of the reflector 14 is formed with the plurality of protruding portions 20 extending in a radial pattern with respect to the optical axis Ax and each of the protruding portions 20 has a total reflection prism of which a cross section belonging to a plane perpendicular to the optical axis Ax is set to have approximately a V shape, it is possible to realize the total reflection on the exterior surface 14*b* over almost the entire area of the reflector 14 and to make the direction of the totally reflected light approximately parallel to the direction of light reflected from the interior surface 14*a*. As a result, most of the light beams emitted from the light source 12*a* can be effectively used as illumination light emitted toward the front side of the lighting device.

In addition, since the reflector 14 is divided into the twelve fan-shaped reflective regions 14A, 14B, 14C, 14D, 14E, 14F, 14G, 14H, 14I, 14J, 14K, and 14L each having the three protruding portions 20 and among the twelve fan-shaped reflective regions 14A, 14B, 14C, 14D, 14E, 14F, 14G, 14H, 14I, 14J, 14K, and 14L, the fan-shaped reflective regions 14D and 14J, which are disposed in the left and right directions of the optical axis Ax, reflects the light emitted from the light source 12*a* in the direction deviating from the direction of the optical axis Ax within the plane including the optical axis Ax more than the fan-shaped reflective regions 14A and 14G located in the up and down directions of the optical axis Ax, it is possible to form the high-beam mode light distribution pattern PH1 as the horizontally long light distribution pattern by means of the light reflected from the reflector 14.

Specifically, the axis-including cross sectional shape of the interior surface 14*a* of each of the fan-shaped reflective regions 14A and 14G is the parabola P of which a symmetrical axis is the optical axis Ax and of which a focus is the emission center of the light source 12*a*, and the axis-including cross sectional shape of the interior surface 14*a* of each of the fan-shaped reflective regions 14D and 14J is the hyperbola H3 obtained by modifying the parabola P. Accordingly, as compared with a light distribution pattern formed in the case when the axis-including cross sectional shape is the parabola P, the light distribution patterns Pd and Pj formed by the light reflected from the fan-shaped reflective regions 14D and 14J can be formed as horizontally long light distribution patterns obtained, for example, by extending the light distribution pattern formed in the above case in the left and right directions. As a result, the high-beam mode light distribution pattern PH1, which is formed by entire light illumination from the vehicle lighting device 10, can be formed as a horizontally long light distribution pattern.

As describe above, according to the present exemplary embodiment, in the vehicle lighting device 10 with the reflector 14 having the transflective member, it is possible to effectively use most of the light beams emitted from the light source 12*a* as illumination light emitted toward the front side of the vehicle lighting device 10 and to form a horizontally long light distribution pattern.

Further, in the present exemplary embodiment, each of the light distribution patterns Pb, Pf, Ph, and Pl, which are formed by the light reflected from the fan-shaped reflective regions 14B, 14F, 14H, and 14L located at the left and right sides of the fan-shaped reflective regions 14A and 14G, is obtained by slightly expanding the light distribution pattern shown by a double dotted chain line in the direction deviating from H-V, and each of the light distribution patterns Pc, Pe, Pi, and Pk, which are formed by the light reflected from the fan-shaped reflective regions 14C, 14E, 14I, and 14K, is obtained by expanding the light distribution pattern shown by a double dotted chain line in the direction deviating from H-V and at an angle slightly larger than for the light distribution patterns Pb, Pf, Ph, and Pl. As a result, the high-beam mode light distribution pattern PH1 can have a desirable light intensity distribution.

Furthermore, in the present exemplary embodiment, the cross sectional shape perpendicular to the optical axis Ax in the interior surface 14*a* of each of the fan-shaped reflective regions 14A, 14B, 14C, 14D, 14E, 14F, 14G, 14H, 14I, 14J, 14K, and 14L is set to the arc shape having the optical axis Ax as the center, and the cross sectional shape perpendicular to the optical axis Ax in the pair of inclined surfaces forming each of the protruding portions 20 is set to the convex curve. Accordingly, as compared with a case in which those shapes are straight lines, it is possible to make the light, which is emitted from the light source 12*a* to be then incident on each of the fan-shaped reflective regions 14A, 14B, 14C, 14D, 14E, 14F, 14G, 14H, 14I, 14J, 14K, and 14L, reflected in the same direction as the light incident on the corresponding one of the fan-shaped reflective regions 14A, 14B, 14C, 14D, 14E, 14F, 14G, 14H, 14I, 14J, 14K, and 14L with high precision. As a result, it is possible to control the light outgoing from each of the fan-shaped reflective regions 14A, 14B, 14C, 14D, 14E, 14F, 14G, 14H, 14I, 14J, 14K, and 14L and the light reflected from the interior surface 14*a* thereof with high precision.

In addition, in the present exemplary embodiment, even though the reflector 14 is divided into the twelve fan-shaped reflective regions 14A, 14B, 14C, 14D, 14E, 14F, 14G, 14H, 14I, 14J, 14K, and 14L each having the same central angle, it is possible that the reflector 14 is divided into any number of fan-shaped reflective regions or the twelve fan-shaped reflective regions 14A, 14B, 14C, 14D, 14E, 14F, 14G, 14H, 14I, 14J, 14K, and 14L have different central angles. In addition, in the present exemplary embodiment, even though the exterior surface 14*b* of each of the fan-shaped reflective regions 14A, 14B, 14C, 14D, 14E, 14F, 14G, 14H, 14I, 14J, 14K, and 14L is formed with the three protruding portions 20 each having the same shape, it is possible that the exterior surface 14*b* is formed with any number of protruding portions 20 or the protruding portions 20 have different shapes.

Next, a second exemplary embodiment of the invention will be described.

Figure 9:
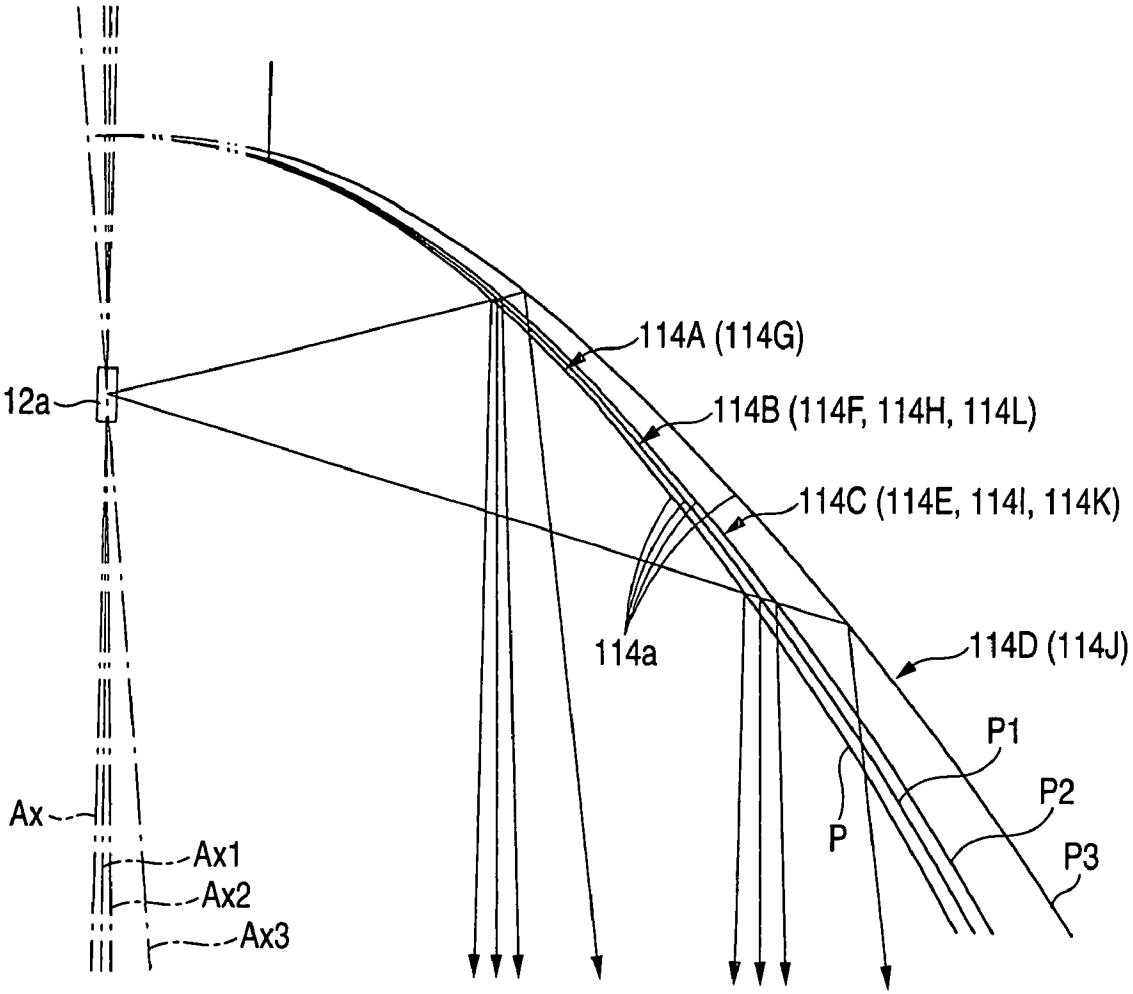
FIG. 9 is a view illustrating the configuration of a second exemplary embodiment of the invention, which corresponds to FIG. 6.
Figure 10:
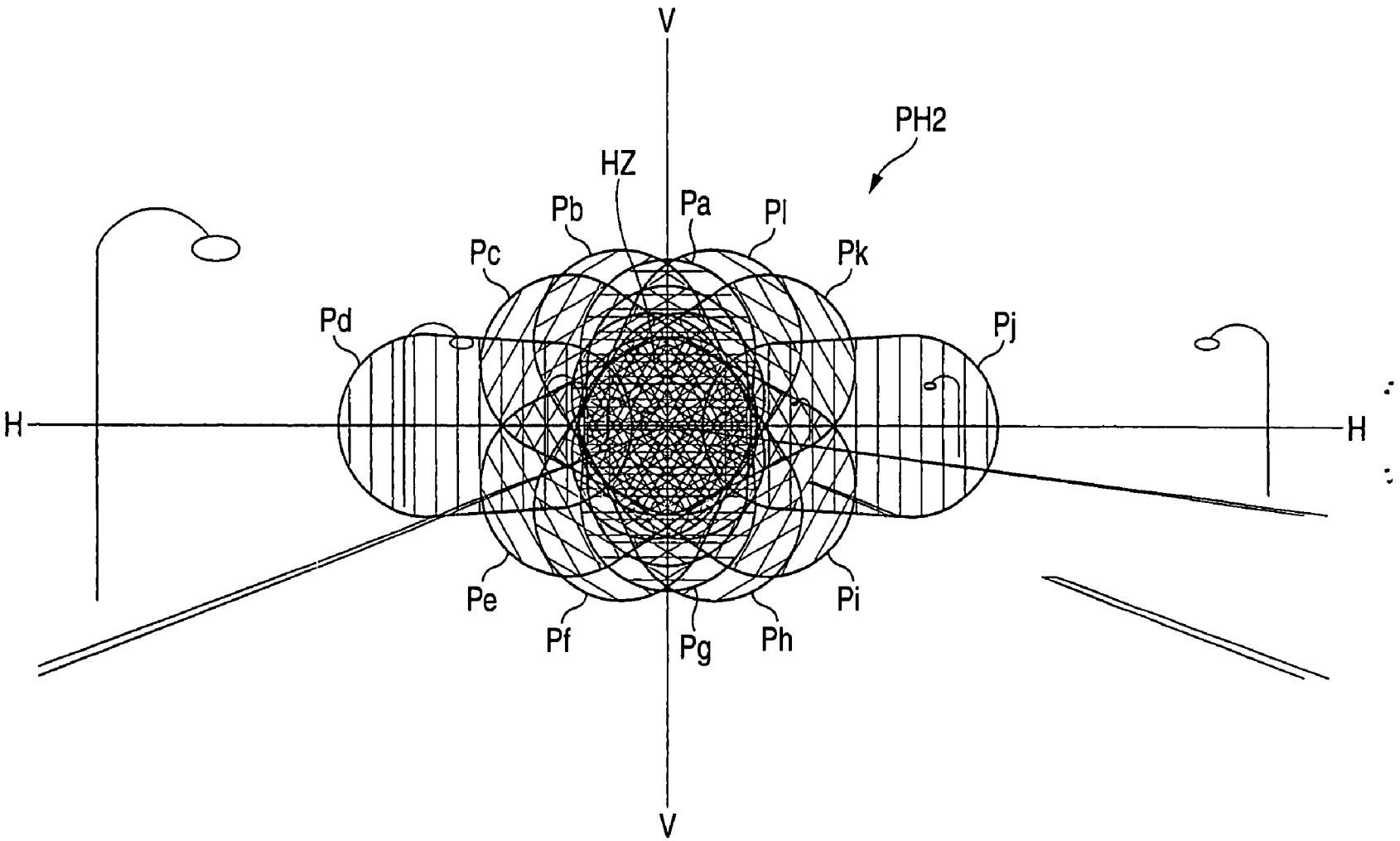
FIG. 10 is a view illustrating an operation of the second exemplary embodiment of the invention, which corresponds to FIG. 7.
Figure 11:
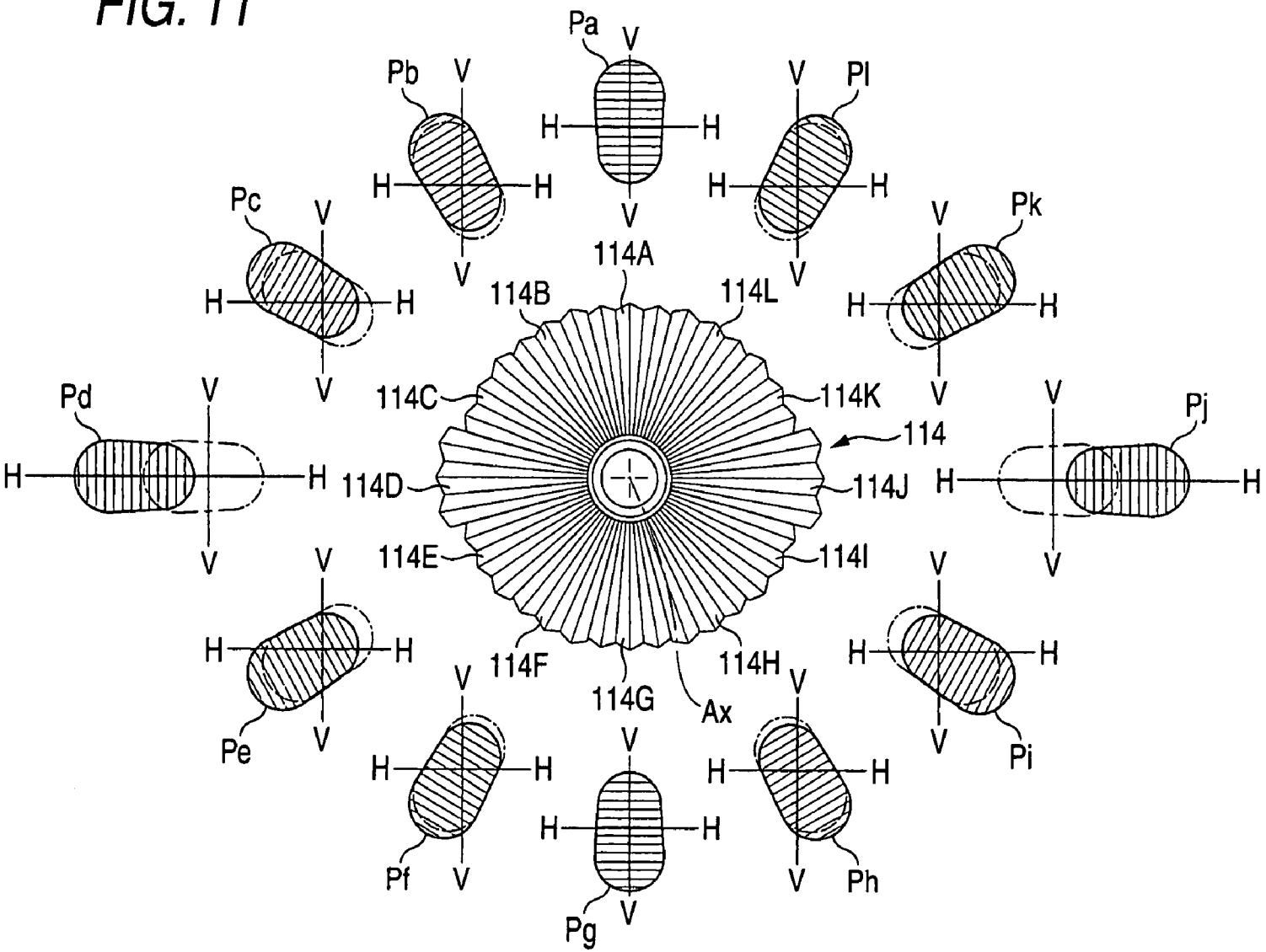
FIG. 11 is a view illustrating an operation of the second exemplary embodiment of the invention, which corresponds to FIG. 8.

FIGS. 9, 10, and 11 are views illustrating a vehicle lighting device according to the second exemplary embodiment and an operation thereof, which correspond to FIGS. 6, 7, and 8, respectively.

As shown in FIGS. 9, 10, and 11, a basic configuration of a vehicle lighting device according to the present exemplary embodiment is the same as that in the first exemplary embodiment, except that the shape of a reflective surface of a reflector 114 is partially different from that of the reflector 14 in the first exemplary embodiment.

That is, the reflector 114 in the present exemplary embodiment is also divided into twelve fan-shaped reflective regions 114A, 114B, 114C, 114D, 114E, 114F, 114G, 114H, 114I, 114J, 114K, and 114L each having central angle of 30° with respect to the optical axis Ax as the center. However, the axis-including cross sectional shape of an interior surface 114*a* of each of the fan-shaped reflective regions 114A, 114B, 114C, 114D, 114E, 114F, 114G, 114H, 114I, 114J, 114K, and 114L is different from that in the first exemplary embodiment. In addition, the configuration of an exterior surface of each of the fan-shaped reflective regions 114A, 114B, 114C, 114D, 114E, 114F, 114G, 114H, 114I, 114J, 114K, and 114L is the same as that in the first exemplary embodiment.

The fan-shaped reflective region 114A located immediately above the optical axis Ax has completely the same configuration as the fan-shaped reflective region 14A in the first exemplary embodiment, and the axis-including cross sectional shape of the interior surface 114*a* is the parabola P having the optical axis Ax as a symmetrical axis and the emission center of the light source 12*a* as a focus. The fan-shaped reflective region 114G located immediately below the optical axis Ax has also the same configuration as the fan-shaped reflective region 14G in the first exemplary embodiment.

The axis-including cross sectional shape of the interior surface 114*a* of each of the fan-shaped reflective regions 114B and 114L, which are adjacent to left and right sides of the fan-shaped reflective region 114A, and the fan-shaped reflective regions 114F and 114H, which are adjacent to left and right sides of the fan-shaped reflective region 114G, is a curve (that is, a parabola P1 having an axial line, which is slightly inclined with respect to the optical axis Ax, as a symmetrical axis Ax1) obtained by slightly expanding the parabola P in the direction deviating from the optical axis Ax with the focus of the parabola P as the center. Accordingly, by means of the fan-shaped reflective regions 114B, 114L, 114F, and 114H, it is possible to reflect the light emitted from the light source 12*a* so as to be slightly deflected in the direction deviating from the optical axis Ax.

The axis-including cross sectional shape of the interior surface 114*a* of each of the fan-shaped reflective regions 114C and 114K, which are respectively adjacent to left and right sides of the fan-shaped reflective regions 114B and 114L, and the axis-including cross sectional shape of the interior surface 114*a* of each of the fan-shaped reflective regions 114E and 114I, which are respectively adjacent to left and right sides of the fan-shaped reflective regions 114F and 114H, is a curve (that is, a parabola P2 having an axial line, which is more inclined than the symmetrical axis Ax1, as a symmetrical axis Ax2) obtained by expanding the parabola P in the direction deviating from the optical axis Ax with the focus of the parabola P as the center and more than for the parabola P1. Accordingly, by means of the fan-shaped reflective regions 114C, 114K, 114E, and 114I, it is possible to reflect the light emitted from the light source 12*a* so as to be deflected in the direction deviating from the optical axis Ax and at an angle slightly larger than in the fan-shaped reflective regions 114B, 114L, 114F, and 114H.

The axis-including cross sectional shape of the interior surface 114*a* of each of the pair of fan-shaped reflective regions 114D and 114J, which are disposed in the left and right directions of the optical axis Ax, is a curve (that is, a parabola P3 having an axial line, which is more inclined than for the symmetrical axis Ax2, as a symmetrical axis Ax3) obtained by expanding the parabola P in the direction deviating from the optical axis Ax with the focus of the parabola P as the center and more than for the parabola P2, and a focus of the parabola P3 is positioned at the emission center of the light source 12*a*. Accordingly, by means of the fan-shaped reflective regions 114D and 114J, it is possible to reflect the light emitted from the light source 12*a* so as to be diffused in the direction deviating from the optical axis Ax and at an angle larger than in the fan-shaped reflective regions 114C, 114K, 114E, and 114I.

As shown in FIG. 10, a high-beam mode light distribution pattern PH2 formed by light, which is emitted from the vehicle lighting device according to the present exemplary embodiment to be then illuminated onto the front thereof, is a horizontally long light distribution pattern expanding in left and right directions with respect to H-V as the center and has a hot zone HZ in the central portion.

The high-beam mode light distribution pattern PH2 is a synthesized light distribution pattern obtained by overlapping twelve light distribution patterns Pa, Pb, Pc, Pd, Pe, Pf, Pg, Ph, Pi, Pj, Pk, and Pl that are formed by the light reflected from the twelve fan-shaped reflective regions 114A, 114B, 114C, 114D, 114E, 114F, 114G, 114H, 114I, 114J, 114K, and 114L included in the reflector 114.

As shown in FIG. 11, each of the light distribution patterns Pa, Pb, Pc, Pd, Pe, Pf, Pg, Ph, Pi, Pj, Pk, and Pl is formed with respect to H-V, in the same manner as the positional relationship of an angle of each of the fan-shaped reflective regions 114A, 114B, 114C, 114D, 114E, 114F, 114G, 114H, 114I, 114J, 114K, and 114L with respect to the optical axis Ax.

Since the axis-including cross sectional shape of the interior surface 114*a* of the fan-shaped reflective regions 114A and 114G is the parabola P, the light distribution patterns Pa and Pg become spot shaped light distribution patterns each having H-V as the center.

Further, since the axis-including cross sectional shape of the interior surface 114*a* of each of the fan-shaped reflective regions 114B, 114F, 114H, and 114L is the parabola P1 obtained by slightly expanding the parabola P, each of the light distribution patterns Pb, Pf, Ph, and Pl becomes a spot shaped light distribution pattern obtained by slightly moving the light distribution pattern, which is shown by a double dotted chain line and is formed in a case when the axis-including cross sectional shape of the interior surface 114*a* is the parabola P, in the direction deviating from H-V along the longitudinal direction thereof.

Furthermore, since the axis-including cross sectional shape of the interior surface 114*a* of each of the fan-shaped reflective regions 114C, 114E, 114I, and 114K is the parabola P2 obtained by expanding the parabola P more than for the parabola P1, each of the light distribution patterns Pc, Pe, Pi, and Pk becomes a spot shaped light distribution pattern obtained by moving the light distribution pattern, which is shown by a double dotted chain line and is formed in a case when the axis-including cross sectional shape of the interior surface 114*a* is the parabola P, in the direction deviating from H-V along the longitudinal direction thereof and at an angle slightly larger than for the light distribution patterns Pb, Pf, Ph, and Pl.

Furthermore, since the axis-including cross sectional shape of the interior surface 114*a* of the fan-shaped reflective regions 114D and 114J is the parabola P3 obtained by expanding the parabola P more than for the parabola P2, each of the light distribution patterns Pd and Pj becomes a spot shaped light distribution pattern obtained by moving the light distribution pattern, which is shown by a double dotted chain line and is formed in a case when the axis-including cross sectional shape of the interior surface 114*a* is the parabola P, in the direction deviating from H-V along the longitudinal direction thereof and at an angle larger than for the light distribution patterns Pc, Pe, Pi, and Pk.

In the present exemplary embodiment, all of the light distribution patterns Pa, Pb, Pc, Pd, Pe, Pf, Pg, Ph, Pi, Pj, Pk, and Pl are the spot shaped light distribution patterns formed by the light reflected from the fan-shaped reflective region 114A, 114B, 114C, 114D, 114E, 114F, 114G, 114H, 114I, 114J, 114K, and 114L. At this time, the light distribution patterns Pa and Pg formed by the light, which is reflected from the pair of fan-shaped reflective region 114A and 114G located immediately above and below the optical axis Ax, are formed to have H-V as the center. In contrast, the light distribution patterns Pd and Pj formed by the light, which is reflected from the pair of fan-shaped reflective region 114D and 114J located at left and right sides of the optical axis Ax, are formed at the locations moved in left and right directions from H-V. Accordingly, it is possible to form the high-beam mode light distribution pattern PH2, which is the synthesized light distribution pattern thereof, as a horizontally long light distribution pattern.

Therefore, even in the second exemplary embodiment, the same effects as in the first exemplary embodiment can be obtained.

Further, in the present exemplary embodiment, each of the light distribution patterns Pb, Pf, Ph, and Pl, which are formed by the light reflected from the fan-shaped reflective regions 114B, 114F, 114H, and 114L located at the left and right sides of the fan-shaped reflective regions 114A and 114G, is obtained by slightly moving the light distribution pattern shown by a double dotted chain line in the direction deviating from H-V, and each of the light distribution patterns Pc, Pe, Pi, and Pk, which are formed by the light reflected from the fan-shaped reflective regions 114C, 114E, 114I, and 114K, is obtained by moving the light distribution pattern shown by a double dotted chain line in the direction deviating from H-V and at an angle slightly larger than for the light distribution patterns Pb, Pf, Ph, and Pl. As a result, the high-beam mode light distribution pattern PH2 can have a desirable light intensity distribution.

Next, a third exemplary embodiment of the invention will be described.

Figure 12:
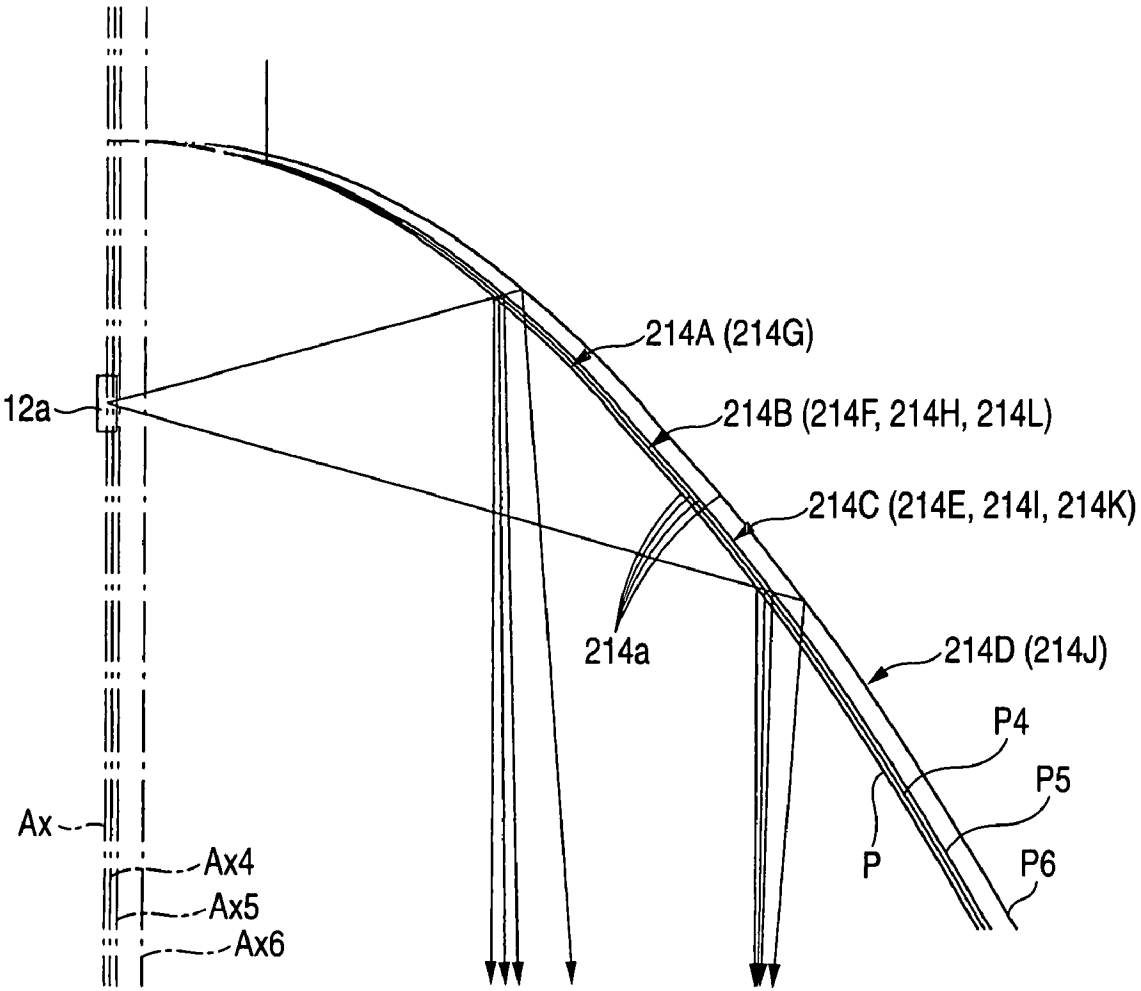
FIG. 12 is a view illustrating the configuration of a third exemplary embodiment of the invention, which corresponds to FIG. 6.
Figure 13:
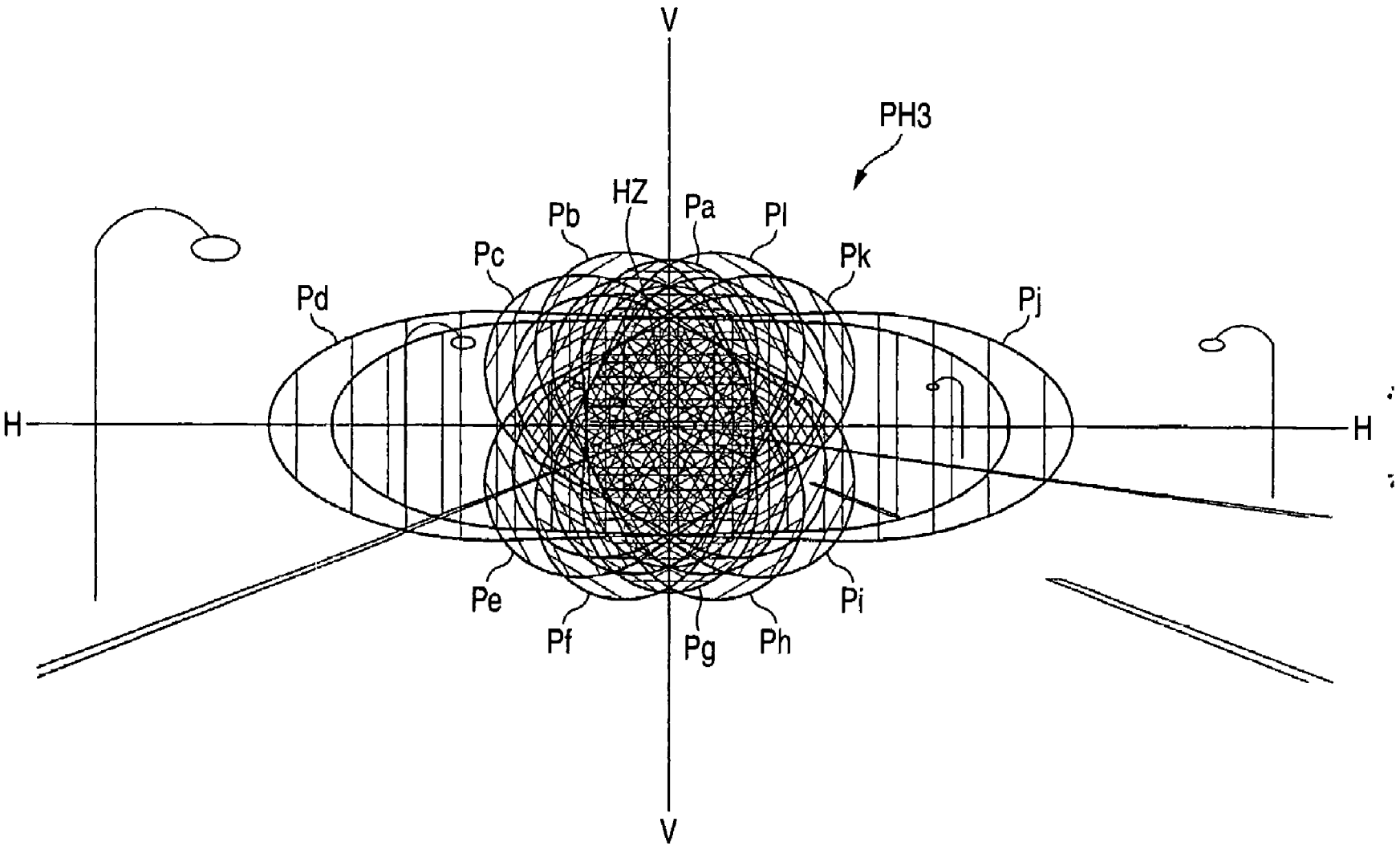
FIG. 13 is a view illustrating an operation of the third exemplary embodiment of the invention, which corresponds to FIG. 7.
Figure 14:
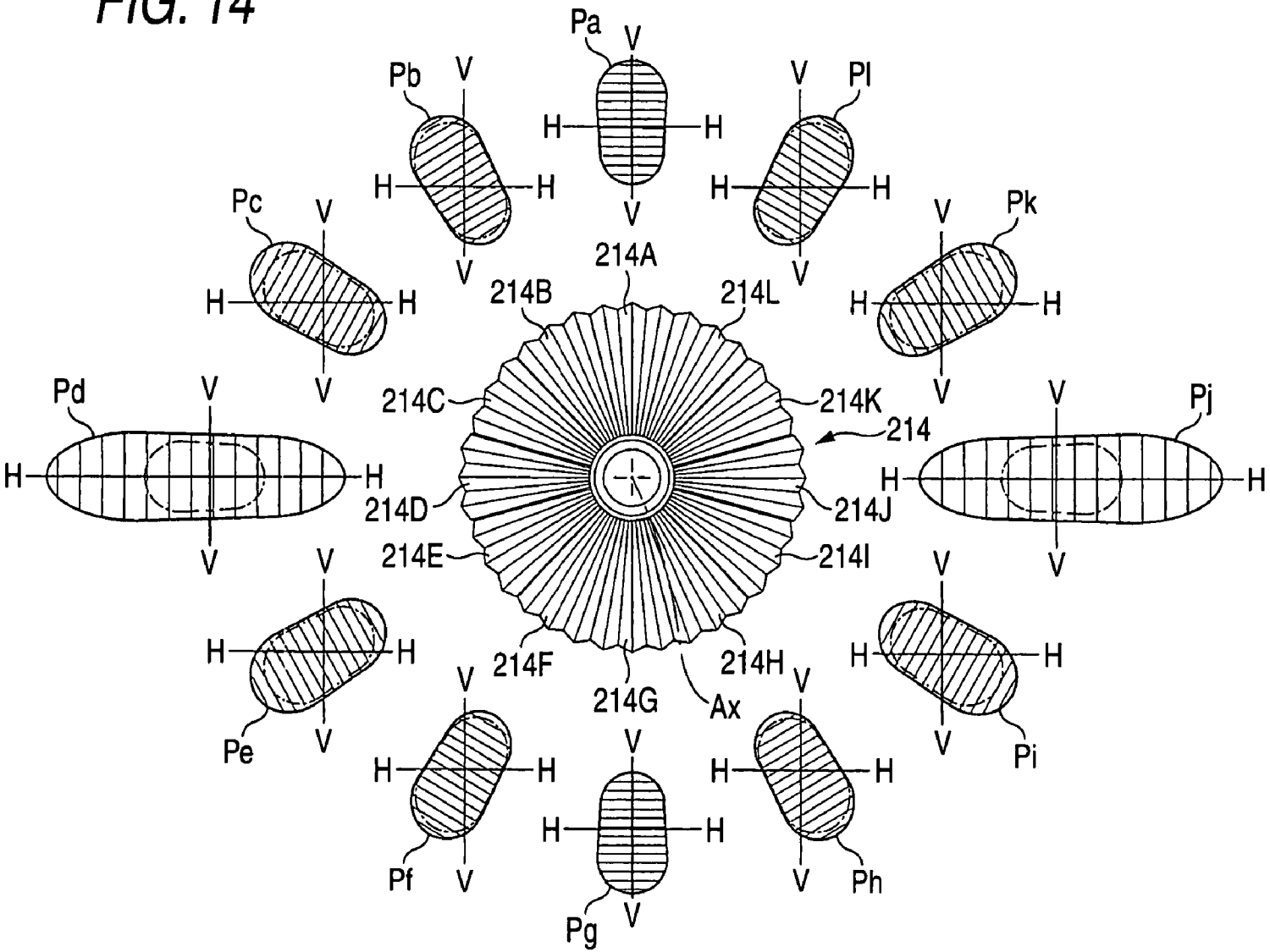
FIG. 14 is a view illustrating an operation of the third exemplary embodiment of the invention, which corresponds to FIG. 8.

FIGS. 12, 13, and 14 are views illustrating a vehicle lighting device according to the third exemplary embodiment and an operation thereof, which correspond to FIGS. 6, 7, and 8, respectively.

As shown in FIGS. 9, 10, and 11, a basic configuration of a vehicle lighting device according to the present exemplary embodiment is the same as that in the first exemplary embodiment, except that the shape of a reflective surface of a reflector 214 is partially different from that of the reflector 14 in the first exemplary embodiment.

That is, the reflector 214 in the present exemplary embodiment is also divided into twelve fan-shaped reflective regions 214A, 214B, 214C, 214D, 214E, 214F, 214G, 214H, 214I, 214J, 214K, and 214L each having central angle of 30° with respect to the optical axis Ax as the center, in the same manner as the reflector 14 in the first exemplary embodiment; however, the axis-including cross sectional shape of an interior surface 214*a* of each of the fan-shaped reflective regions 214A, 214B, 214C, 214D, 214E, 214F, 214G, 214H, 214I, 214J, 214K, and 214L is different from that in the first exemplary embodiment. In addition, the configuration of an exterior surface of each of the fan-shaped reflective regions 214A, 214B, 214C, 214D, 214E, 214F, 214G, 214H, 214I, 214J, 214K, and 214L is the same as that in the first exemplary embodiment.

The fan-shaped reflective region 214A located immediately above the optical axis Ax has completely the same configuration as the fan-shaped reflective region 14A in the first exemplary embodiment, and the axis-including cross sectional shape of the interior surface 214*a* is the parabola P having the optical axis Ax as a symmetrical axis and the emission center of the light source 12*a* as a focus. The fan-shaped reflective region 214G located immediately below the optical axis Ax has also the same configuration as the fan-shaped reflective region 14G in the first exemplary embodiment.

The axis-including cross sectional shape of the interior surface 214*a* of each of the fan-shaped reflective regions 214B and 214L, which are adjacent to left and right sides of the fan-shaped reflective region 214A, and the fan-shaped reflective regions 214F and 214H, which are adjacent to left and right sides of the fan-shaped reflective region 214G, is a curve (that is, a parabola P4 having an axial line parallel to the optical axis Ax as a symmetrical axis Ax4) obtained by slightly moving the parabola P in the direction deviating from the optical axis Ax and in parallel to the parabola P. Accordingly, by means of the fan-shaped reflective regions 214B, 214L, 214F, and 214H, it is possible to reflect the light emitted from the light source 12*a* so as to be slightly diffused in the direction deviating from the optical axis Ax. At this time, the light emitted from the light source 12*a* is reflected in the direction deviating from the optical axis Ax at the location close to an inner periphery of the interior surface 114*a*; on the other hand, the light emitted from the light source 12*a* is reflected in the direction close to the optical axis Ax at the location close to an outer periphery of the interior surface 114*a*. This is because the focus of the parabola P4 deviates from the focus of the parabola P in the direction deviating from the optical axis Ax.

The axis-including cross sectional shape of the interior surface 214*a* of each of the fan-shaped reflective regions 214C and 214K, which are respectively adjacent to left and right sides of the fan-shaped reflective regions 214B and 214L, and the axis-including cross sectional shape of the interior surface 214*a* of each of the fan-shaped reflective regions 214E and 214I, which are respectively adjacent to left and right sides of the fan-shaped reflective regions 214F and 214H, is a curve (that is, a parabola P5 having an axial line parallel to the optical axis Ax as a symmetrical axis Ax5) obtained by moving the parabola P in the direction deviating from the optical axis Ax more than for the parabola P4. Accordingly, by means of the fan-shaped reflective regions 214C, 214K, 214E, and 214I, it is possible to reflect the light emitted from the light source 12*a* so as to be diffused in the direction deviating from the optical axis Ax and at an angle slightly larger than in the fan-shaped reflective regions 214B, 214L, 214F, and 214H.

The axis-including cross sectional shape of the interior surface 214*a* of each of the pair of fan-shaped reflective regions 214D and 214J, which are disposed in the left and right directions of the optical axis Ax, is a curve (that is, a parabola P6 having an axial line parallel to the optical axis Ax as a symmetrical axis Ax6) obtained by moving the parabola P in the direction deviating from the optical axis Ax than for the parabola P5. Accordingly, by means of the fan-shaped reflective regions 214D and 214J, it is possible to reflect the light emitted from the light source 12*a* so as to be diffused in the direction deviating from the optical axis Ax and at an angle larger than in the fan-shaped reflective regions 214C, 214K, 214E, and 214I.

As shown in FIG. 13, a high-beam mode light distribution pattern PH3 formed by light, which is emitted from the vehicle lighting device according to the present exemplary embodiment to be then illuminated onto the front thereof, is a horizontally long light distribution pattern expanding in left and right directions with respect to H-V as the center and has a hot zone HZ in a central portion thereof.

The high-beam mode light distribution pattern PH3 is a synthesized light distribution pattern obtained by overlapping twelve light distribution patterns Pa, Pb, Pc, Pd, Pe, Pf, Pg, Ph, Pi, Pj, Pk, and Pl that are formed by the light reflected from the twelve fan-shaped reflective regions 214A, 214B, 214C, 214D, 214E, 214F, 214G, 214H, 214I, 214J, 214K, and 214L included in the reflector 214.

As shown in FIG. 14, each of the light distribution patterns Pa, Pb, Pc, Pd, Pe, Pf, Pg, Ph, Pi, Pj, Pk, and Pl is formed with respect to H-V, in the same manner as the positional relationship of an angle of each of the fan-shaped reflective regions 214A, 214B, 214C, 214D, 214E, 214F, 214G, 214H, 214I, 214J, 214K, and 214L with respect to the optical axis Ax.

Since the axis-including cross sectional shape of the interior surface 214*a* of the fan-shaped reflective regions 214A and 214G is the parabola P, the light distribution patterns Pa and Pg become spot shaped light distribution patterns each having H-V as the center.

Further, since the axis-including cross sectional shape of the interior surface 214*a* of each of the fan-shaped reflective regions 214B, 214F, 214H, and 214L is the parabola P4 obtained by slightly moving the parabola P in parallel, each of the light distribution patterns Pb, Pf, Ph, and Pl becomes a spot shaped light distribution pattern obtained by slightly expanding the light distribution pattern, which is shown by a double dotted chain line and is formed in a case when the axis-including cross sectional shape of the interior surface 214*a* is the parabola P, in the direction along both sides of the longitudinal direction thereof.

Furthermore, since the axis-including cross sectional shape of the interior surface 214*a* of each of the fan-shaped reflective regions 214C, 214E, 214I, and 214K is the parabola P5 obtained by moving the parabola P more than for the parabola P4, each of the light distribution patterns Pc, Pe, Pi, and Pk becomes a light distribution pattern obtained by expanding the light distribution pattern, which is shown by a double dotted chain line and is formed in a case when the axis-including cross sectional shape of the interior surface 214*a* is the parabola P, in the direction along both the sides of the longitudinal direction thereof and at an angle slightly larger than for the light distribution patterns Pb, Pf, Ph, and Pl.

Furthermore, since the axis-including cross sectional shape of the interior surface 214*a* of the fan-shaped reflective regions 214D and 214J is the parabola P6 obtained by expanding the parabola P more than for the parabola P5, each of the light distribution patterns Pd and Pj becomes a light distribution pattern obtained by expanding the light distribution pattern, which is shown by a double dotted chain line and is formed in a case when the axis-including cross sectional shape of the interior surface 214*a* is the parabola P, in the direction along both the sides of the longitudinal direction thereof and at an angle larger than for the light distribution patterns Pc, Pe, Pi, and Pk.

As shown in the figures, each of the light distribution patterns Pb, Pc, Pd, Pe, Pf, Ph, Pi, Pj, Pk, and Pl has a shape formed by slightly expanding the light distribution pattern shown by a double dotted chain line even in the direction perpendicular to the longitudinal direction, as well as the longitudinal direction. This is because focuses of the parabolas P4, P5, and P6 deviate from the focus of the parabola P in the direction deviating from the optical axis Ax.

In the present exemplary embodiment, among the light distribution patterns Pa, Pb, Pc, Pd, Pe, Pf, Pg, Ph, Pi, Pj, Pk, and Pl formed by the light reflected from the fan-shaped reflective regions 214A, 214B, 214C, 214D, 214E, 214F, 214G, 214H, 214I, 214J, 214K, and 214L, the light distribution patterns Pa and Pg formed by the light, which is reflected from the pair of fan-shaped reflective region 214A and 214G located immediately above and below the optical axis Ax, are formed to have H-V as the center. In contrast, each of the light distribution patterns Pd and Pj formed by the light, which is reflected from the pair of fan-shaped reflective region 214D and 214J located at left and right sides of the optical axis Ax, is a horizontally long light distribution pattern expanding in the left and right directions from H-V. As a result, the high-beam mode light distribution pattern PH3, which is formed by entire light illumination from the vehicle lighting device, can be formed as a horizontally long light distribution pattern.

Therefore, even in the third exemplary embodiment, the same effects as in the first exemplary embodiment can be obtained.

Further, in the present exemplary embodiment, each of the light distribution patterns Pb, Pf, Ph, and Pl, which are formed by the light reflected from the fan-shaped reflective regions 214B, 214F, 214H, and 214L located at the left and right sides of the fan-shaped reflective regions 214A and 214G, is obtained by slightly expanding the light distribution pattern shown by a double dotted chain line in the longitudinal direction thereof, and each of the light distribution patterns Pc, Pe, Pi, and Pk, which are formed by the light reflected from the fan-shaped reflective regions 214C, 214E, 214I, and 214K, is obtained by expanding the light distribution pattern shown by a double dotted chain line in the longitudinal direction and at an angle slightly larger than for the light distribution patterns Pb, Pf, Ph, and Pl. As a result, the high-beam mode light distribution pattern PH3 can have a desirable light intensity distribution.

At this time, each of the light distribution patterns Pb, Pc, Pd, Pe, Pf, Ph, Pi, Pj, Pk, and Pl has a shape formed by slightly expanding the light distribution pattern shown by a double dotted chain line even in the direction perpendicular to the longitudinal direction, as well as the longitudinal direction. Accordingly, the high-beam mode light distribution pattern PH3 can have a more desirable light intensity distribution.

Next, a fourth exemplary embodiment of the invention will be described.

Figure 15:
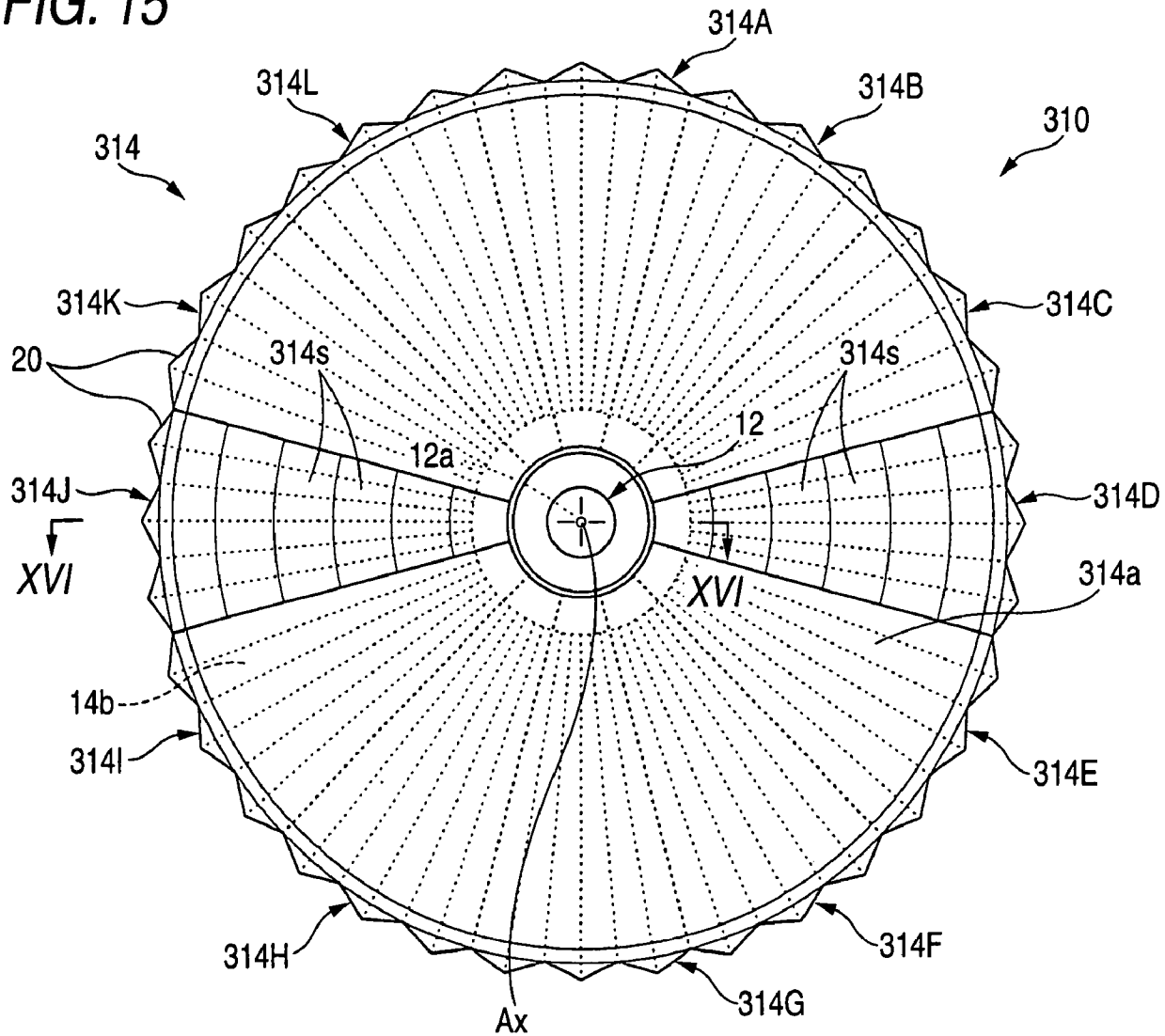
FIG. 15 is a view illustrating a vehicle lighting device according to a fourth exemplary embodiment of the invention, which corresponds to FIG. 1.
Figure 16:
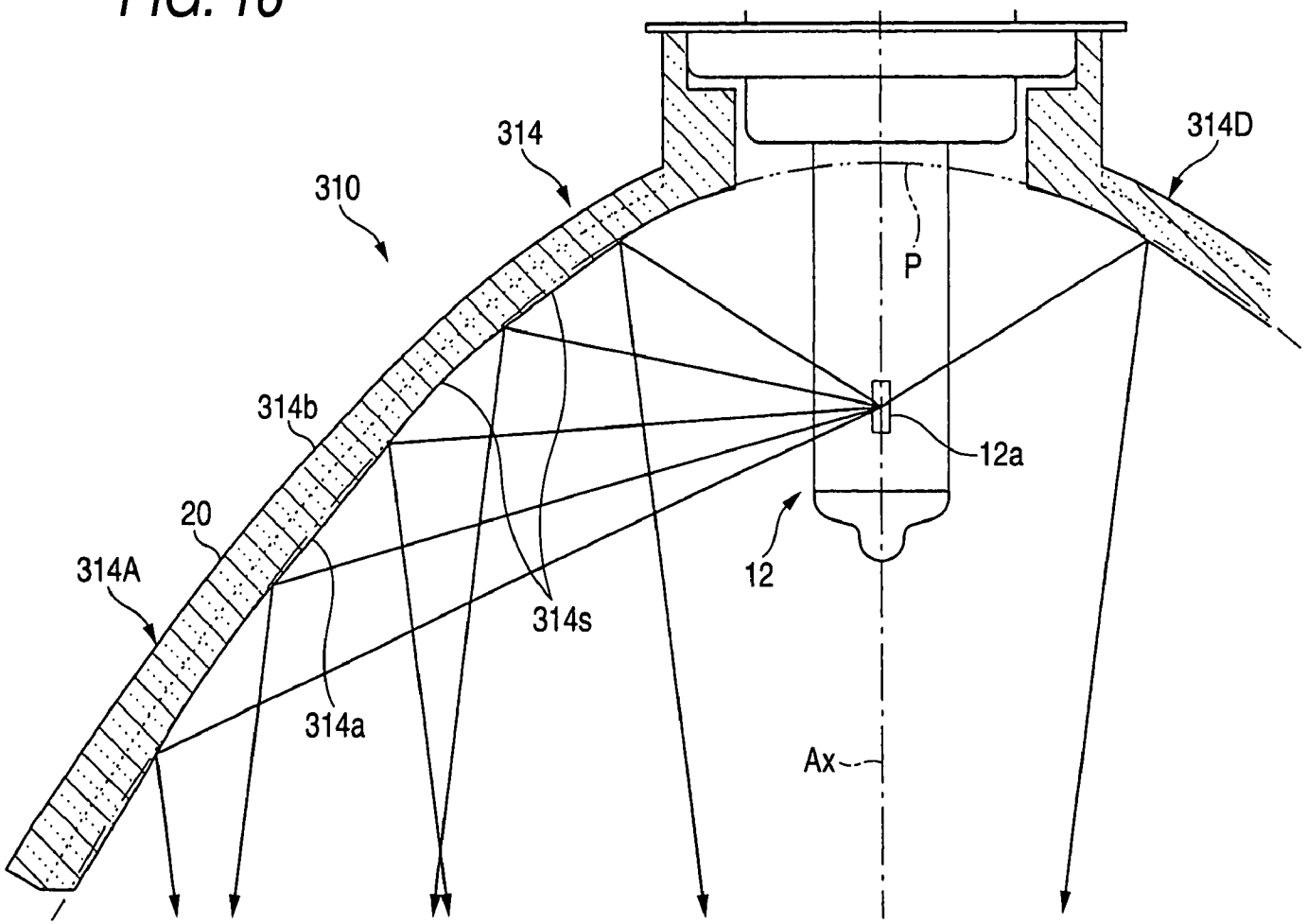
FIG. 16 is a detailed cross-sectional view taken along the line XVI—XVI of FIG. 15.
Figure 17:
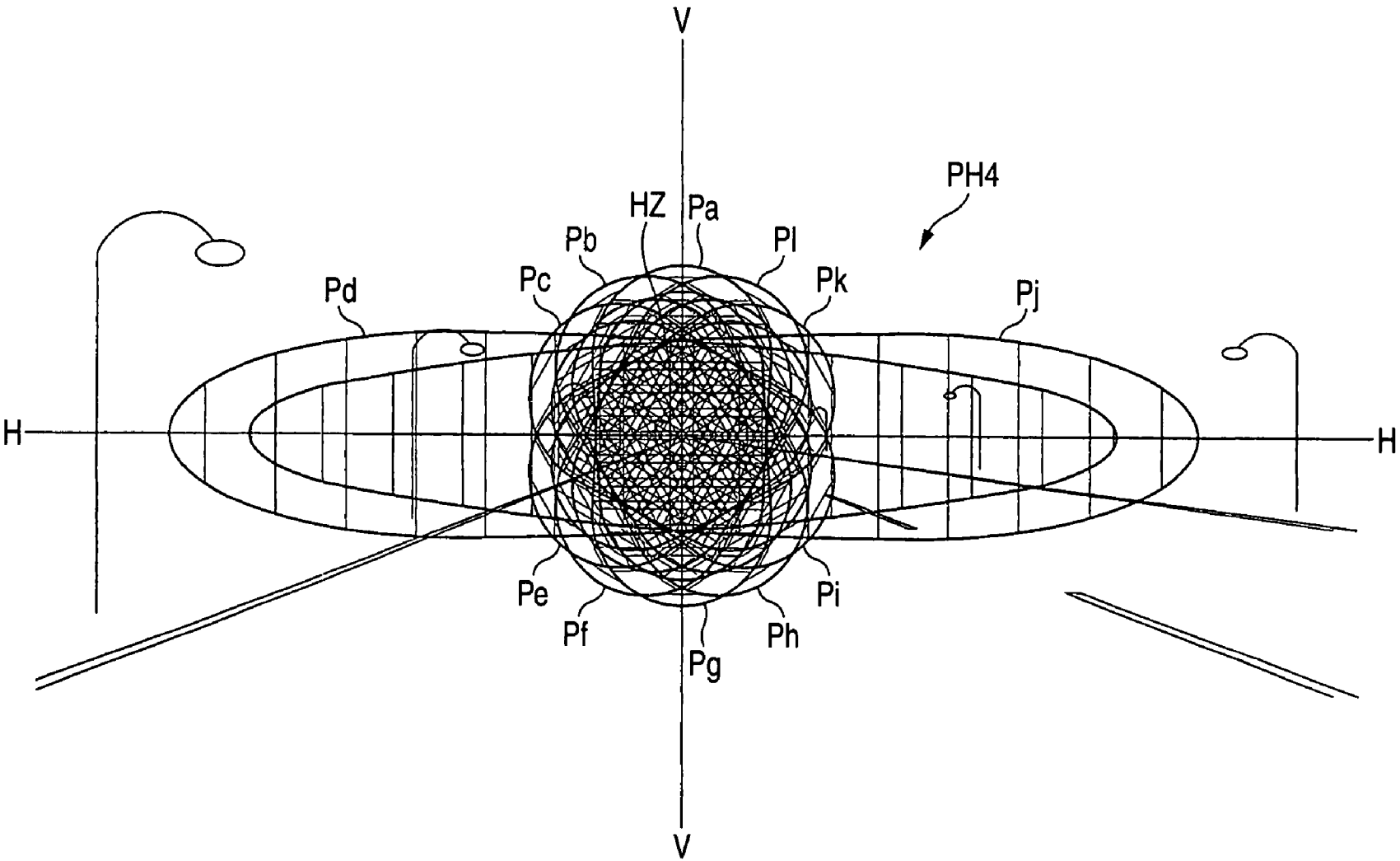
FIG. 17 is a view illustrating an operation of the fourth exemplary embodiment of the invention, which corresponds to FIG. 7.
Figure 18:
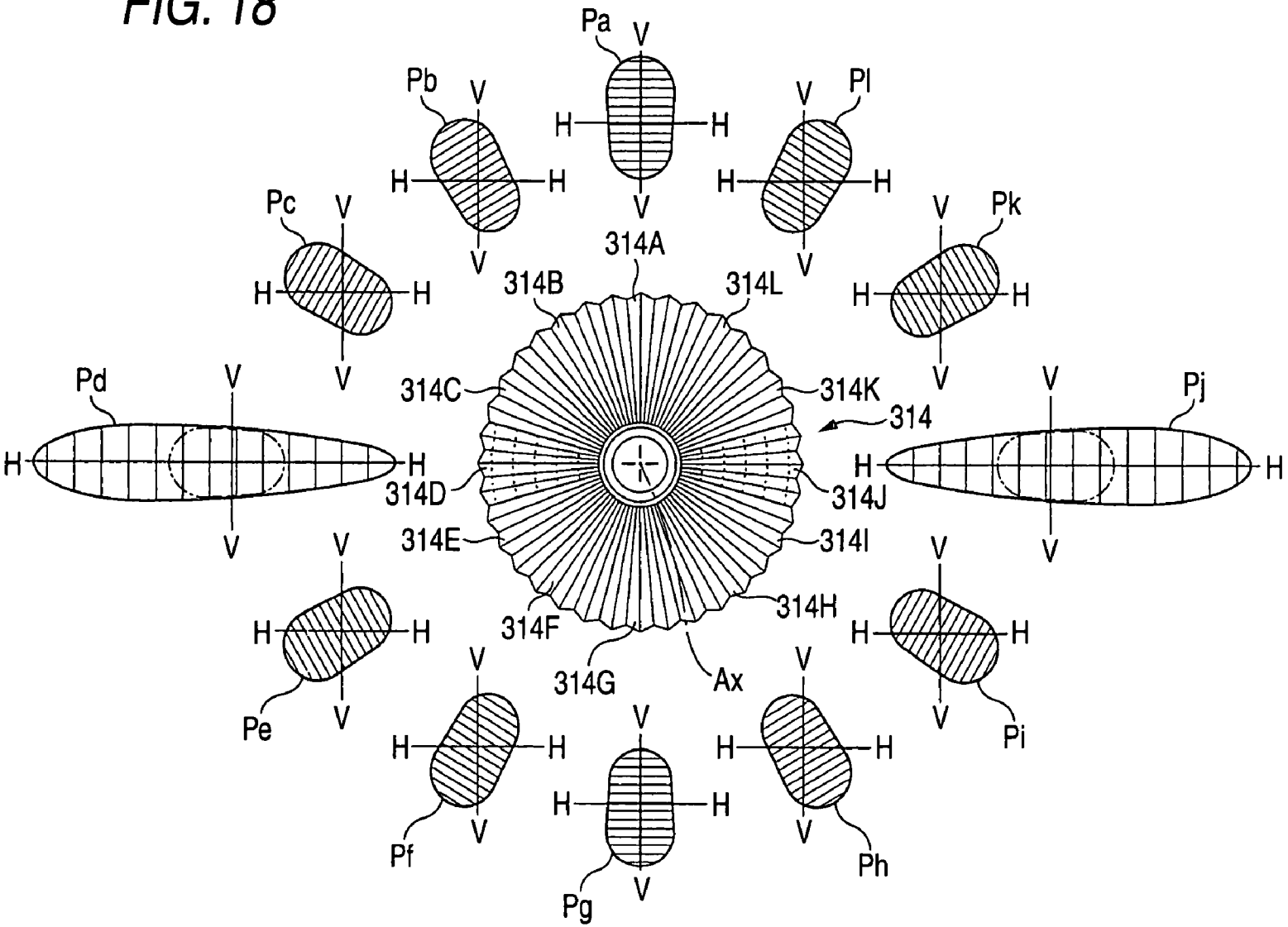
FIG. 18 is a view illustrating an operation of the fourth exemplary embodiment of the invention, which corresponds to FIG. 8.
Figure 19:
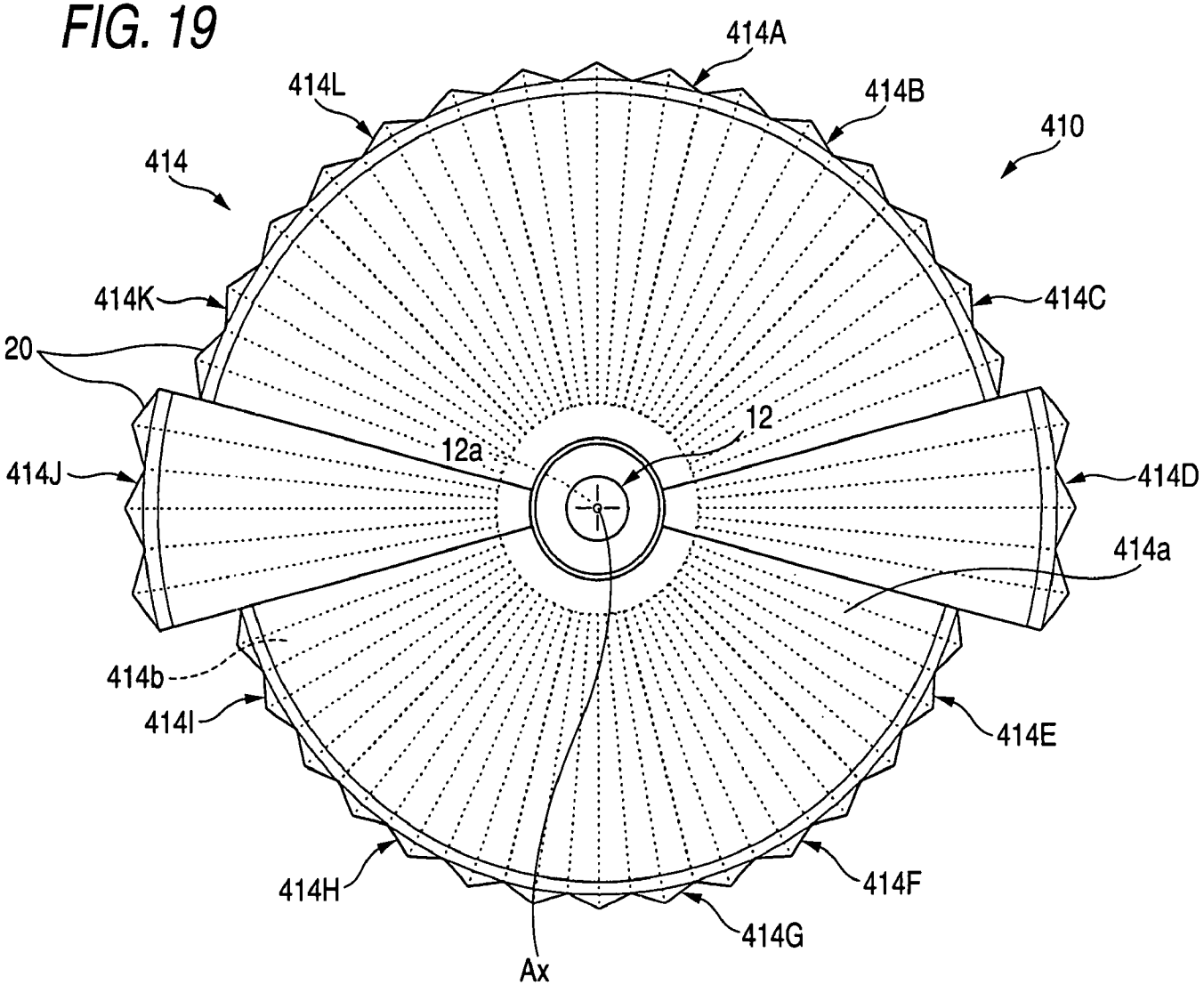
FIG. 19 is a view illustrating the configuration of a fifth exemplary embodiment of the invention, which corresponds to FIG. 1.
Figure 20:
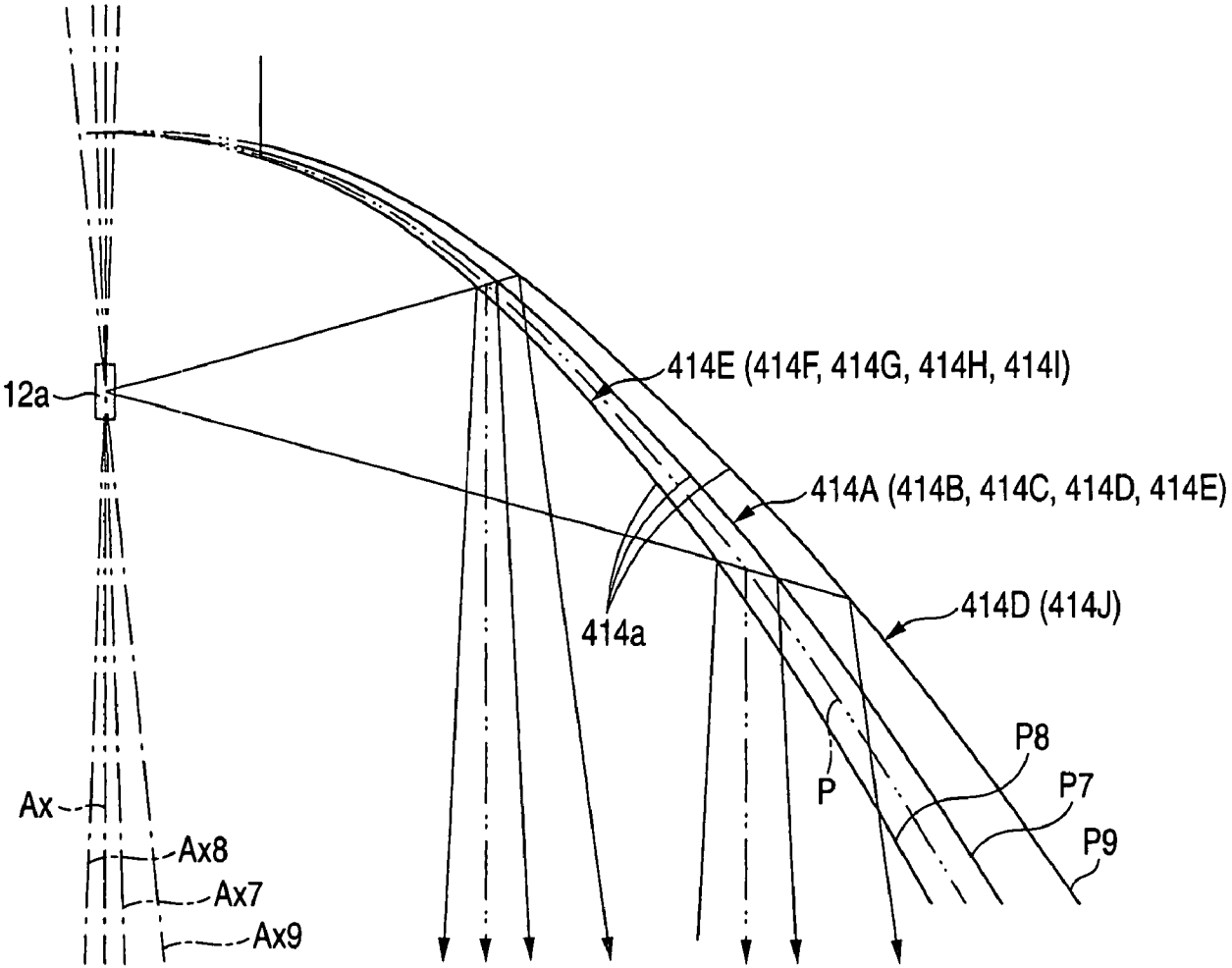
FIG. 20 is a view illustrating the configuration of the fifth exemplary embodiment of the invention, which corresponds to FIG. 6.

FIG. 15 is a view illustrating a vehicle lighting device according to the fourth exemplary embodiment, which corresponds to FIG. 1. FIG. 16 is a detailed cross-sectional view taken along the line XVI—XVI of FIG. 16. In addition, FIGS. 17 and 18 are views illustrating an operation of the vehicle lighting device according to the present exemplary embodiment, which correspond to FIGS. 7 and 8, respectively.

As shown in FIGS. 15, 16, 17, and 18, a basic configuration of a vehicle lighting device according to the present exemplary embodiment is the same as that in the first exemplary embodiment, except that the shape of a reflective surface of a reflector 314 is partially different from that of the reflector 14 in the first exemplary embodiment.

That is, the reflector 314 in the present exemplary embodiment is also divided into twelve fan-shaped reflective regions 314A, 314B, 314C, 314D, 314E, 314F, 314G, 314H, 314I, 314J, 314K, and 314L each having central angle of 30° with respect to the optical axis Ax as the center, in the same manner as the reflector 14 in the first exemplary embodiment; however, the axis-including cross sectional shape of an interior surface 314*a* of each of the fan-shaped reflective regions 314A, 314B, 314C, 314D, 314E, 314F, 314G, 314H, 314I, 314J, 314K, and 314L is different from that in the first exemplary embodiment. In addition, an exterior surface of each of the fan-shaped reflective regions 314A, 314B, 314C, 314D, 314E, 314F, 314G, 314H, 314I, 314J, 314K, and 314L is formed with three protruding portions 20 extending in a radial pattern with respect to the optical axis Ax, in the same manner as in the first exemplary embodiment.

The fan-shaped reflective region 314A located immediately above the optical axis Ax has completely the same configuration as the fan-shaped reflective region 14A in the first exemplary embodiment, and the axis-including cross sectional shape of the interior surface 314*a* is the parabola P having the optical axis Ax as a symmetrical axis and the emission center of the light source 12*a* as a focus. This can be applied to the other nine fan-shaped reflective regions 314B, 314C, 314E, 314F, 314G, 314H, 314I, 314K, and 314L, except for the pair of fan-shaped reflective regions 314D and 314J located at the left and right sides of the optical axis Ax.

The axis-including cross sectional shape of an interior surface 314*a* of each of the fan-shaped reflective regions 314D and 314J is a waveform curve having irregularities with the parabola P as a reference line, and each of the fan-shaped reflective regions 314D and 314J is formed such that a plurality of diffusive reflection elements 314*s* is smoothly connected to each other. In addition, each of the fan-shaped reflective regions 314D and 314J reflects the light emitted from the light source 12*a* so as to be diffused in the diameter direction with respect to the optical axis Ax.

Further, even though only an optical path of the light reflected from the interior surface 314*a* is shown in FIG. 16, light, which is totally reflected from each protruding portion 20 of the exterior surface 314*b* to then outgo from the interior surface 314*a*, is diffused in the direction deviating from the optical axis Ax.

As shown in FIG. 17, a high-beam mode light distribution pattern PH4 formed by light, which is emitted from the vehicle lighting device according to the present exemplary embodiment to be then illuminated onto the front thereof, is a horizontally long light distribution pattern expanding in left and right directions with respect to H-V as the center and has a hot zone HZ in a central portion thereof.

The high-beam mode light distribution pattern PH4 is a synthesized light distribution pattern obtained by overlapping twelve light distribution patterns Pa, Pb, Pc, Pd, Pe, Pf, Pg, Ph, Pi, Pj, Pk, and Pl that are formed by the light reflected from the twelve fan-shaped reflective regions 314A, 314B, 314C, 314D, 314E, 314F, 314G, 314H, 314I, 314J, 314K, and 314L included in the reflector 314.

As shown in FIG. 18, each of the light distribution patterns Pa, Pb, Pc, Pd, Pe, Pf, Pg, Ph, Pi, Pj, Pk, and Pl is formed with respect to H-V, in the same manner as the positional relationship of an angle of each of the fan-shaped reflective regions 314A, 314B, 314C, 314D, 314E, 314F, 314G, 314H, 314I, 314J, 314K, and 314L with respect to the optical axis Ax.

Since the axis-including cross sectional shape of the interior surface 314*a* of each of the fan-shaped reflective regions 314A, 314B, 314C, 314D, 314E, 314F, 314G, 314H, 314I, 314J, 314K, and 314L is the parabola P, all of the light distribution patterns Pa, Pb, Pc, Pd, Pe, Pf, Pg, Ph, Pi, Pj, Pk, and Pl are the spot shaped light distribution patterns each having H-V as the center.

Since the axis-including cross sectional shape of an interior surface 314*a* of each of the fan-shaped reflective regions 314D and 314J is a waveform curve having irregularities with the parabola P as a reference line and the plurality of diffusive reflection elements 314*s* reflects the light emitted from the light source 12*a* so as to be diffused in the diameter direction with respect to the optical axis Ax, each of the light distribution patterns Pd and Pj becomes a light distribution pattern obtained by expanding the light distribution pattern, which is shown by a double dotted chain line and is formed in a case when the axis-including cross sectional shape of the interior surface 314*a* is the parabola P, in the direction along both sides of the longitudinal direction thereof.

In the present exemplary embodiment, among the light distribution patterns Pa, Pb, Pc, Pd, Pe, Pf, Pg, Ph, Pi, Pj, Pk, and Pl formed by the light reflected from the fan-shaped reflective regions 314A, 314B, 314C, 314D, 314E, 314F, 314G, 314H, 314I, 314J, 314K, and 314L, the light distribution patterns Pa and Pg formed by the light, which is reflected from the pair of fan-shaped reflective region 314A and 314G located immediately above and below the optical axis Ax, are formed to have H-V as the center. In contrast, each of the light distribution patterns Pd and Pj formed by the light, which is reflected from the pair of fan-shaped reflective region 314D and 314J located at left and right sides of the optical axis Ax, is a horizontally long light distribution pattern expanding in the left and right directions from H-V. As a result, the high-beam mode light distribution pattern PH4, which is formed by entire light illumination from the vehicle lighting device, can be formed as a horizontally long light distribution pattern.

Therefore, even in the fourth exemplary embodiment, the same effects as in the first exemplary embodiment can be obtained.

Further, in the present exemplary embodiment, since the plurality of diffusive reflection elements 314*s* reflects the light emitted from the light source 12*a* in the diameter direction with respect to the optical axis Ax not in the left and right directions thereof, each of the light distribution patterns has a shape formed by slightly expanding the light distribution pattern shown by a double dotted chain line in the up and down directions as well as the left and right directions. Accordingly, the light distribution patterns Pd and Pj can be smoothly connected to the other light distribution patterns Pa, Pb, Pc, Pe, Pf, Pg, Ph, Pi, Pk, and Pl.

Furthermore, in the present exemplary embodiment, since the five fan-shaped reflective regions 314A, 314B, 314C, 314K, and 314L, which are located above the optical axis Ax, have the same configurations, those five fan-shaped reflective regions 314A, 314B, 314C, 314K, and 314L may be recognized as one fan-shaped reflective region having a central angle made by combining those five central angles. In addition, since the five fan-shaped reflective regions 314E, 314F, 314G, 314H, and 314I, which are located below the optical axis Ax, have also the same configurations, those five fan-shaped reflective regions 314E, 314F, 314G, 314H, and 314I may be recognized as one fan-shaped reflective region having a central angle made by combining those five central angles.

Next, a fifth exemplary embodiment of the invention will be described.

FIGS. 19, 20, 21, and 22 are views illustrating a vehicle lighting device according to the second exemplary embodiment and an operation thereof, which correspond to FIGS. 1, 6, 7, and 8, respectively.

As shown in FIGS. 19, 20, 21, and 22, a basic configuration of a vehicle lighting device 410 according to the present exemplary embodiment is the same as that in the first exemplary embodiment, except that the shape of a reflective surface of a reflector 414 is partially different from that of the reflector 14 in the first exemplary embodiment.

That is, the reflector 414 in the present exemplary embodiment is also divided into twelve fan-shaped reflective regions 414A, 414B, 414C, 414D, 414E, 414F, 414G, 414H, 414I, 414J, 414K, and 414L each having central angle of 30° with respect to the optical axis Ax as the center, in the same manner as the reflector 14 in the first exemplary embodiment; however, the axis-including cross sectional shape of an interior surface 414*a* of each of the fan-shaped reflective regions 414A, 414B, 414C, 414D, 414E, 414F, 414G, 414H, 414I, 414J, 414K, and 414L is different from that in the first exemplary embodiment. In addition, the configuration of an exterior surface of each of the fan-shaped reflective regions 414A, 414B, 414C, 414D, 414E, 414F, 414G, 414H, 414I, 414J, 414K, and 414L is the same as that in the first exemplary embodiment.

The axis-including cross sectional shape of the interior surface 414*a* of the fan-shaped reflective region 414A located immediately above the optical axis Ax is a curve (that is, a parabola P7 having an axial line, which is slightly inclined from the optical axis Ax, as a symmetrical axis Ax7) obtained by slightly expanding the parabola P, which forms the axis-including cross sectional shape of the interior surface 414*a* of the fan-shaped reflective region 14A in the first exemplary embodiment, in the direction deviating from the optical axis Ax with the focus of the parabola P as the center. Accordingly, by means of the fan-shaped reflective region 414A, it is possible to reflect the light emitted from the light source 12*a* so as to be slightly deflected in the direction deviating from the optical axis Ax. The configurations and operations of the fan-shaped reflective regions 414B and 414L, which are adjacent to left and right sides of the fan-shaped reflective region 414A, and the fan-shaped reflective regions 414C and 414K, which are respectively adjacent to left and right sides of the fan-shaped reflective region 414B and 414L are the same as those in the fan-shaped reflective region 414A.

The axis-including cross sectional shape of the interior surface 414*a* of the fan-shaped reflective region 414G located immediately below the optical axis Ax is a curve (that is, a parabola P8 having an axial line, which is slightly inclined from the optical axis Ax and is located to be opposite to the symmetrical axis Ax7, as a symmetrical axis Ax8) obtained by slightly expanding the parabola P in the direction deviating from the optical axis Ax with the focus of the parabola P as the center. Accordingly, by means of the fan-shaped reflective region 414G, it is possible to make the light emitted from the light source 12*a* cross the optical axis Ax and then to reflect the light so as to be slightly deflected in the direction deviating from the optical axis Ax. The configurations and operations of the fan-shaped reflective regions 414F and 414H, which are adjacent to left and right sides of the fan-shaped reflective region 414G, and the fan-shaped reflective regions 414E and 414I, which are respectively adjacent to left and right sides of the fan-shaped reflective region 414F and 414H are the same as those in the fan-shaped reflective region 414G.

The axis-including cross sectional shape of the interior surface 414*a* of each of the pair of fan-shaped reflective regions 414D and 414J, which are disposed in the left and right directions of the optical axis Ax, is a curve (that is, a parabola P9 having an axial line, which is more inclined than for the symmetrical axis Ax7, as a symmetrical axis Ax9) obtained by expanding the parabola P in the direction deviating from the optical axis Ax with the focus of the parabola P as the center and more than for the parabola P7, and a focus of the parabola P9 is positioned at the emission center of the light source 12*a*. Accordingly, by means of the fan-shaped reflective regions 414D and 414J, it is possible to reflect the light emitted from the light source 12*a* so as to be diffused in the direction deviating from the optical axis Ax and at an angle larger than in the fan-shaped reflective regions 414C, 414K, 414E, and 414I.

Figure 21:
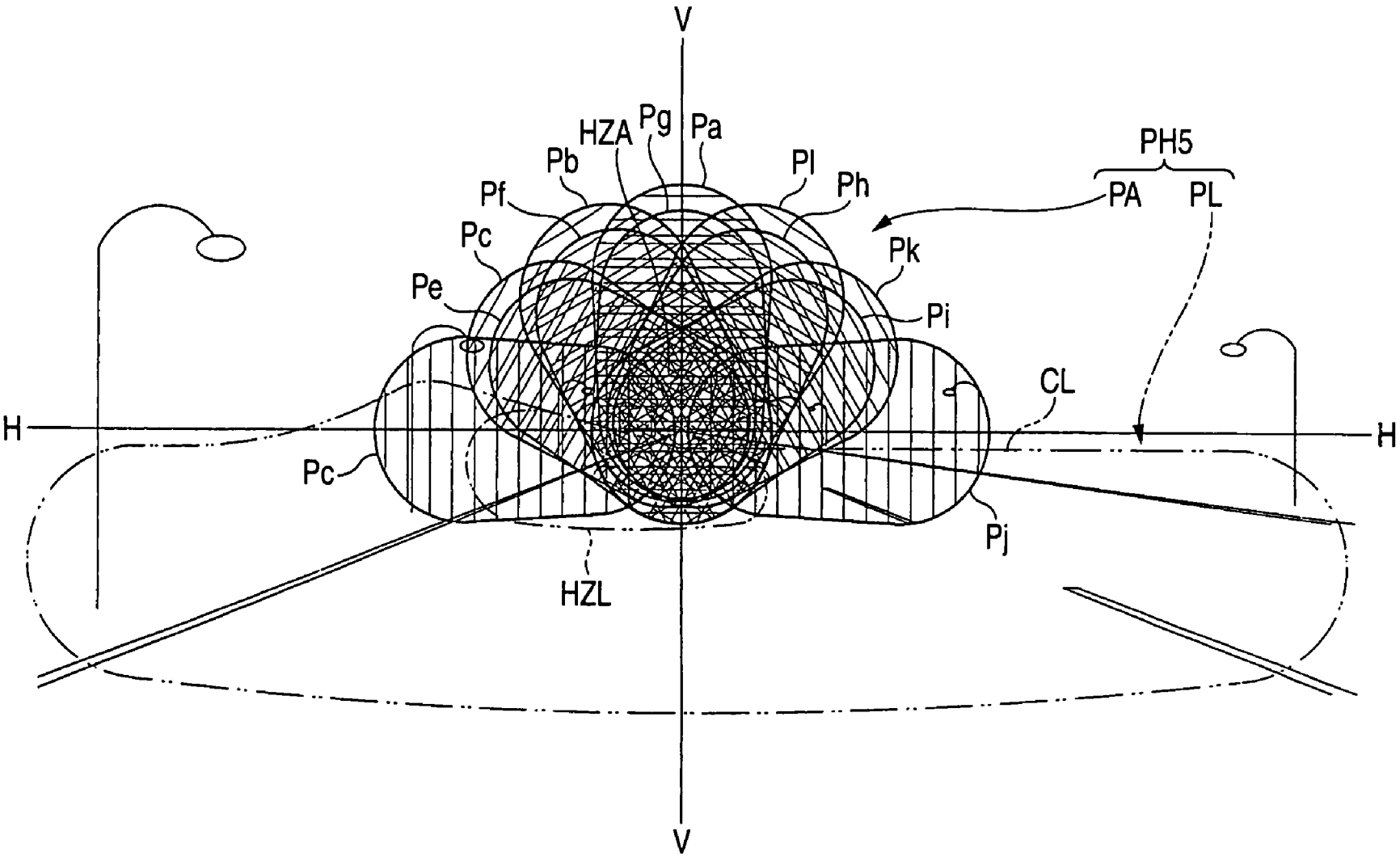
FIG. 21 is a view illustrating an operation of the fifth exemplary embodiment of the invention, which corresponds to FIG. 7.

As shown in FIG. 21, the vehicle lighting device 410 in the present exemplary embodiment forms an additive light distribution pattern PA by light illumination thereof. The additive light distribution pattern PA is additionally formed with respect to a low-beam mode light distribution pattern PL, which is formed by light illumination of a vehicle lighting device (not shown). As a synthetic light distribution pattern of the additive light distribution pattern PA and the low-beam mode light distribution pattern PL, a high-beam mode light distribution pattern PH5 is formed.

The low-beam mode light distribution pattern PL has a cutoff line CL in an upper end portion thereof and a hot zone HZL following the cutoff line CL in a central portion thereof.

The additive light distribution pattern PA is formed as a horizontally long light distribution pattern expanding in the left and right directions with H-V as the center. At this time, the additive light distribution pattern PA expands in the left and right directions, and at the same time expands slightly in an upper direction. However, the additive light distribution pattern PA does not nearly expand in a lower direction. This is because a region located below H-V is illuminated sufficiently brightly by the low-beam mode light distribution pattern PL formed as a part of the high-beam mode light distribution pattern PH5, so that a region ranging from a short distance of a road surface to an intermediate distance thereof is not excessively bright due to the overlapping of the additive light distribution pattern PA.

In addition, in the high-beam mode light distribution pattern PH5, a hot zone is formed by overlapping the hot zone HZL and the hot zone HZA each other.

The additive light distribution pattern PA is a synthesized light distribution pattern obtained by overlapping the twelve light distribution patterns Pa, Pb, Pc, Pd, Pe, Pf, Pg, Ph, Pi, Pj, Pk, and Pl that are formed by the light reflected from the twelve fan-shaped reflective regions 414A, 414B, 414C, 414D, 414E, 414F, 414G, 414H, 414I, 414J, 414K, and 414L included in the reflector 414.

Figure 22:
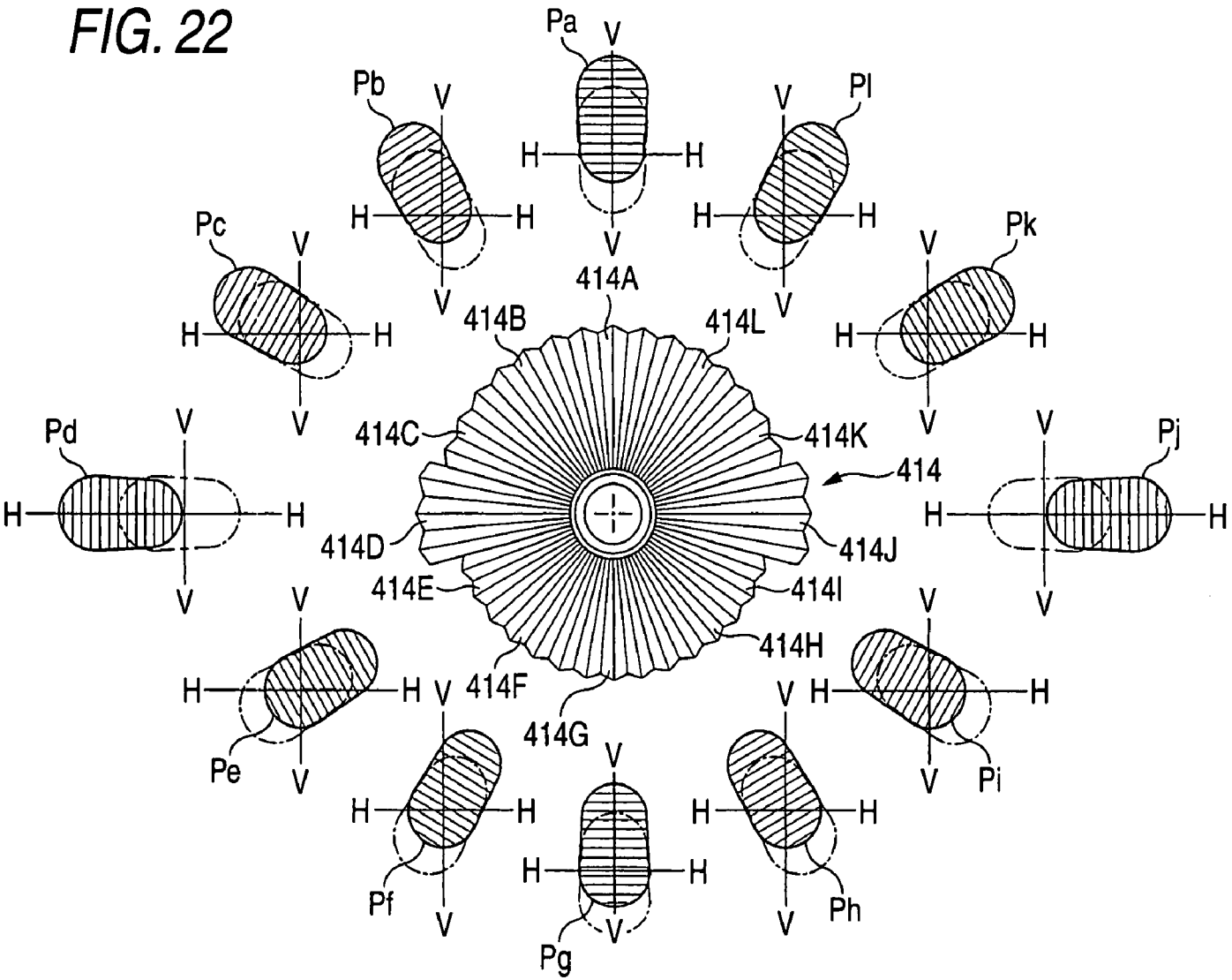
FIG. 22 is a view illustrating an operation of the fifth exemplary embodiment of the invention, which corresponds to FIG. 8.

As shown in FIG. 22, each of the light distribution patterns Pa, Pb, Pc, Pd, Pe, Pf, Pg, Ph, Pi, Pj, Pk, and Pl is formed with respect to H-V, in the same manner as the positional relationship of an angle of each of the fan-shaped reflective regions 414A, 414B, 414C, 414D, 414E, 414F, 414G, 414H, 414I, 414J, 414K, and 414L with respect to the optical axis Ax.

Since the axis-including cross sectional shape of the interior surface 414*a* of each of the fan-shaped reflective regions 414A, 414B, 414C, 414K, and 414L located above the optical axis Ax is the parabola P7 obtained by making the parabola P slightly inclined, each of the light distribution patterns Pa, Pb, Pc, Pk, and Pl becomes a spot shaped light distribution pattern obtained by slightly moving the light distribution pattern, which is shown by a double dotted chain line and is formed in a case when the axis-including cross sectional shape of the interior surface 114*a* is the parabola P, in the upper direction along the longitudinal direction thereof.

Further, since the axis-including cross sectional shape of the interior surface 414*a* of each of the fan-shaped reflective regions 414E, 414F, 414G, 414H, and 414I located below the optical axis Ax is the parabola P8 obtained by making the parabola P slightly inclined so as to be opposite to the parabola P7, each of the light distribution patterns Pe, Pf, Pg, Ph, and Pi becomes a spot shaped light distribution pattern obtained by slightly moving the light distribution pattern, which is shown by a double dotted chain line and is formed in a case when the axis-including cross sectional shape of the interior surface 114*a* is the parabola P, in the upper direction along the longitudinal direction thereof.

Furthermore, since the axis-including cross sectional shape of the interior surface 414*a* of each of the fan-shaped reflective regions 414D and 414J is the parabola P9 obtained by making the parabola P inclined more than for the parabola P7, each of the light distribution patterns Pd and Pj becomes a spot shaped light distribution pattern obtained by moving the light distribution pattern, which is shown by a double dotted chain line and is formed in a case when the axis-including cross sectional shape of the interior surface 114*a* is the parabola P, in the left and right directions along the longitudinal direction thereof.

In the present exemplary embodiment, all of the light distribution patterns Pa, Pb, Pc, Pd, Pe, Pf, Pg, Ph, Pi, Pj, Pk, and Pl are the spot shaped light distribution patterns formed by the light reflected from the fan-shaped reflective region 414A, 414B, 414C, 414D, 414E, 414F, 414G, 414H, 414I, 414J, 414K, and 414L, and the positions at which the light distribution patterns Pa, Pb, Pc, Pd, Pe, Pf, Pg, Ph, Pi, Pj, Pk, and Pl are formed are different. Accordingly, it is possible to form the additive light distribution pattern PA, which is formed as a synthesized light distribution pattern of the light distribution patterns Pa, Pb, Pc, Pd, Pe, Pf, Pg, Ph, Pi, Pj, Pk, and Plurality of, so as to be horizontally long and protrude only in the upper direction.

Therefore, even in the fifth exemplary embodiment, the same effects as in the first exemplary embodiment can be obtained.

Further, in the present exemplary embodiment, since the light distribution patterns Pa, Pb, Pc, Pk, and Pl, which are formed by the light reflected from the fan-shaped reflective regions 414A, 414B, 414C, 414K, and 414L located above the optical axis Ax, and the light distribution patterns Pe, Pf, Pg, Ph, and Pi, which are formed by the light reflected from the fan-shaped reflective regions 414E, 414F, 414G, 414H, and 414I located below the optical axis Ax, are all the spot shaped light distribution patterns obtained by slightly moving the light distribution pattern shown by the double dotted chain line in the upper direction along the longitudinal direction thereof, it is possible to form those light distribution patterns Pa, Pb, Pc, Pk, Pl, Pe, Pf, Pg, Ph, and Pi as a light distribution pattern which does not expand below the light distribution patterns Pd and Pj formed by the light reflected from the fan-shaped reflective regions 414D and 414J. As a result, it is possible to form the additive light distribution pattern PA as a light distribution pattern suitable for being additionally formed with respect to the low-beam mode light distribution pattern PL, so as to form the high-beam mode light distribution pattern PH5.

Furthermore, in the present exemplary embodiment, since the five fan-shaped reflective regions 414A, 414B, 414C, 414K, and 414L, which are located above the optical axis Ax, have the same configurations, those five fan-shaped reflective regions 414A, 414B, 414C, 414K, and 414L may be recognized as one fan-shaped reflective region having a central angle made by combining those five central angles. In addition, since the five fan-shaped reflective regions 414E, 414F, 414G, 414H, and 414I, which are located below the optical axis Ax, have also the same configurations, those five fan-shaped reflective regions 414E, 414F, 414G, 414H, and 414I may be recognized as one fan-shaped reflective region having a central angle made by combining those five central angles.

Next, a specific example in which the vehicle lighting device 10 according to the first exemplary embodiment is mounted as a headlamp unit will be described.

Figure 23:
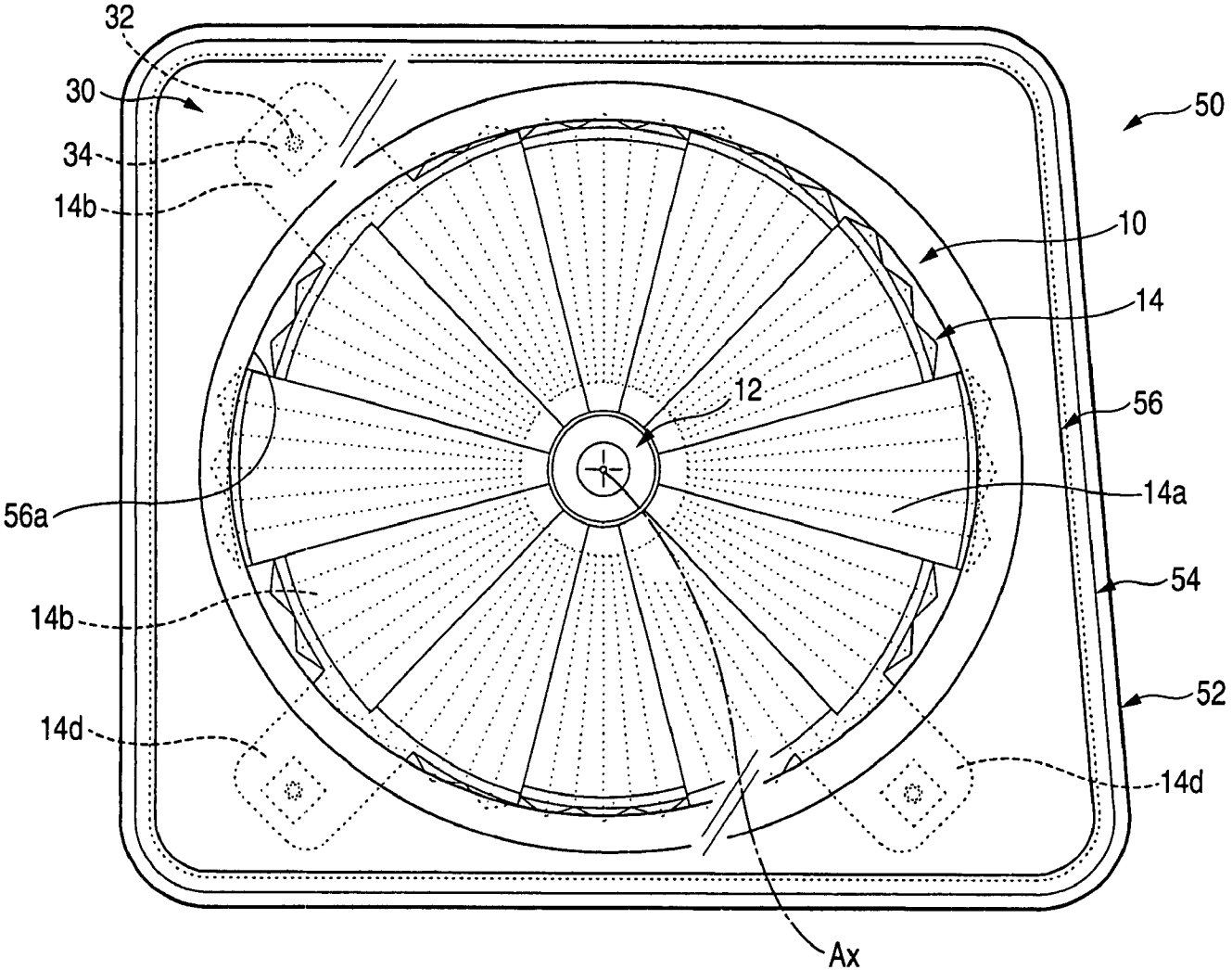
FIG. 23 is a front view illustrating a headlamp in which the vehicle lighting device according to the first exemplary embodiment is mounted as a headlamp unit.

FIG. 23 is a front view illustrating a headlamp 50 in which the vehicle lighting device 10 according to the first exemplary embodiment is mounted as a headlamp unit.

As shown in FIG. 23, the headlamp 50 includes a lamp body 52, a transmissive cover 54 which is mounted at a front-end opening portion of the lamp body 52 and is made of a transparent glass, and the vehicle lighting device 10 accommodated within the lamp body 52. In addition, within the lamp body 52, an inner panel 56 is provided along the transmissive cover 54. The inner panel 56 is formed with an elliptical opening portion 56*a* that surrounds a reflector 14.

In the headlamp 50, the vehicle lighting device 10 is supported on the lamp body 52 through an aiming mechanism 30 so that the vehicle lighting device 10 can move to be inclined in the up and down directions and in the left and right directions.

The aiming mechanism 30 includes three aiming screws 32 disposed in an L shape. A base end portion of each of the aiming screws 32 is rotatably supported on the lamp body 52, and a front end portion of each of the aiming screws 32 is engaged to the reflector 14 of the vehicle lighting device 10 through an aiming nut 34. At three front-end edges of the reflector 14, taps 14*d* that extend in a radial pattern with respect to the optical axis Ax are formed. In addition, the aiming nut 34 is mounted at each of the taps 14*d*.

As such, by using a construction in which the taps 14*d* are formed at the front-end edges, it is possible to achieve a function of performing a total reflection on the exterior surface 14*b*, and the construction can be used as a part of the headlamp 50.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A vehicle lighting device comprising:

a light source disposed on an optical axis extending in front and rear directions of the vehicle lighting device; and a reflector having a transmissive member that reflects light emitted from the light source toward a front of the vehicle lighting device;

wherein the reflector includes a plurality of fan-shaped reflective regions, each of the plurality of fan-shaped reflective regions includes a predetermined number of protruding portions formed on an exterior surface of the reflector and extending in a radial direction with respect to the optical axis, each of the protruding portions has a total reflection prism of which a cross section belonging to a plane perpendicular to the optical axis is set to have approximately a V shape, and a fan-shaped reflective region of the plurality of fan-shaped reflective regions located in left and right directions of the optical axis reflects the light emitted from the light source in a direction deviating from the direction of the optical axis within a plane including the optical axis, more than a fan-shaped reflective region located in up and down directions of the optical axis.

2. The vehicle lighting device according to claim 1, wherein a shape of a cross section, which belongs to a plane including the optical axis, of an interior surface of the fan-shaped reflective region located in the up and down directions of the optical axis is a parabola having a symmetrical axis on the optical axis and a focus on a point near the light source, and a shape of a cross section, which belongs to a plane including the optical axis, of an interior surface of the fan-shaped reflective regions located in the left and right directions of the optical axis is a curve obtained by modifying the parabola.

3. The vehicle lighting device according to claim 1, wherein a shape of a cross section, which belongs to a plane including the optical axis, of an interior surface of the fan-shaped reflective region located in the up and down directions of the optical axis is a parabola having a symmetrical axis on the optical axis and a focus on a point near the light source, and a shape of a cross section, which belongs to a plane including the optical axis, of an interior surface of the fan-shaped reflective regions located in the left and right directions of the optical axis is a curve obtained by making the parabola inclined within the plane with the focus as a center.

4. The vehicle lighting device according to claim 1, wherein a shape of a cross section, which belongs to a plane including the optical axis, of an interior surface of the fan-shaped reflective region located in the up and down directions of the optical axis is a parabola having a symmetrical axis on the optical axis and a focus on a point near the light source, and a shape of a cross section, which belongs to a plane including the optical axis, of an interior surface of the fan-shaped reflective regions located in the left and right directions of the optical axis is a curve obtained by moving the parabola in parallel within the plane including the optical axis.

5. The vehicle lighting device according to claim 1, wherein a shape of a cross section, which belongs to a plane including the optical axis, of an interior surface of the fan-shaped reflective region located in the up and down directions of the optical axis is a parabola having a symmetrical axis on the optical axis and a focus on a point near the light source, and a shape of a cross section, which belongs to a plane including the optical axis, of an interior surface of the fan-shaped reflective regions located in the left and right directions of the optical axis is a waveform curve having irregularities with the parabola as a reference line.

6. The vehicle lighting device according to claim 1, wherein a shape of a cross section, which belongs to a plane including the optical axis, of an interior surface of each of the plurality of fan-shaped reflective regions is an arc shape having the optical axis as a center, and a shape of a cross section, which belongs to the plane perpendicular to the optical axis, of each of a pair of inclined surfaces forming each of the protruding portions is formed by a convex curve.

* * * * *